US011060286B2

(12) United States Patent
Collins et al.

(10) Patent No.: US 11,060,286 B2
(45) Date of Patent: Jul. 13, 2021

(54) PREFABRICATED WALL PANEL FOR UTILITY INSTALLATION

(71) Applicant: Innovative Building Technologies, LLC, Seattle, WA (US)

(72) Inventors: Arlan Collins, Seattle, WA (US); Mark Woerman, Seattle, WA (US)

(73) Assignee: Innovative Building Technologies, LLC, Seattle, WA (US)

( * ) Notice: Subject to any disclaimer, the term of this patent is extended or adjusted under 35 U.S.C. 154(b) by 0 days.

(21) Appl. No.: 16/454,567

(22) Filed: Jun. 27, 2019

(65) Prior Publication Data

US 2019/0316354 A1 Oct. 17, 2019

Related U.S. Application Data

(62) Division of application No. 15/507,654, filed as application No. PCT/US2014/053613 on Aug. 30, 2014, now Pat. No. 10,364,572.

(51) Int. Cl.

| | |
|---|---|
| ***E04C 2/52*** | (2006.01) |
| ***E04C 2/284*** | (2006.01) |
| ***E04C 2/32*** | (2006.01) |
| ***E04C 2/34*** | (2006.01) |
| ***E04C 2/38*** | (2006.01) |

(52) U.S. Cl.

CPC ..... *E04C 2/521* (2013.01); *E04C 2/284* (2013.01); *E04C 2/322* (2013.01); *E04C 2/34* (2013.01); *E04C 2/384* (2013.01)

(58) Field of Classification Search

CPC ..... E04B 2/64; E04B 2/7457; E04B 1/165; E04B 2/723; E04B 2/72; E04B 2/7453; E04B 2/721; E04C 3/34

See application file for complete search history.

(56) References Cited

U.S. PATENT DOCUMENTS

| | | | |
|---|---|---|---|
| 1,168,556 | A | 1/1916 | Robinson et al. |
| 1,501,288 | A | 7/1924 | Morley |
| 1,876,528 | A | 7/1931 | Walters |
| 1,883,376 | A | 10/1932 | George et al. |
| 2,160,161 | A | 5/1939 | Marsh |
| 2,270,268 | A | 1/1942 | Chambers |
| 2,419,319 | A | 4/1947 | Lankton |
| 2,495,862 | A | 1/1950 | Osborn |

(Continued)

FOREIGN PATENT DOCUMENTS

| | | |
|---|---|---|
| AU | 2005200682 | 5/2005 |
| AU | 2012211472 | 2/2014 |

(Continued)

OTHER PUBLICATIONS

US 8,701,371 B2, 04/2014, Collins et al. (withdrawn)

(Continued)

*Primary Examiner* — Jessie T Fonseca

(57) ABSTRACT

An example apparatus is disclosed that may be a utility panel that may include an exterior panel, a plurality of studs coupled to the exterior panel, a hat channel coupled to the plurality of studs opposite the exterior panel, wherein the hat channel is perpendicular to the studs, and an interior panel coupled to the hat channel opposite the plurality of studs. An example method is disclosed for coupling a wall panel to a beam.

18 Claims, 6 Drawing Sheets

(56) References Cited

U.S. PATENT DOCUMENTS 2,562,050 A 7/1951 Lankton
2,686,420 A 8/1954 Youtz
2,722,724 A 11/1955 Miller
2,758,467 A 8/1956 Brown et al.
2,871,544 A 2/1959 Youtz
2,871,997 A 2/1959 Simpson et al.
2,877,990 A 3/1959 Goemann
2,946,413 A 7/1960 Weismann
3,017,723 A 1/1962 Von Heidenstam
3,052,449 A 9/1962 Long et al.
3,053,015 A 9/1962 George
3,053,509 A 9/1962 Haupt et al.
3,065,575 A 11/1962 Ray
3,079,652 A 3/1963 Wahlfeld
3,090,164 A 5/1963 Nels
3,184,893 A 5/1965 Booth
3,221,454 A 12/1965 Giulio
3,235,917 A 2/1966 Skubic
3,236,014 A 2/1966 Edgar
3,245,183 A 4/1966 Tessin
3,281,172 A 10/1966 Kuehl
3,315,424 A 4/1967 Smith
3,324,615 A 6/1967 Zinn
3,324,617 A 6/1967 Knight et al.
3,355,853 A 12/1967 Wallace
3,376,919 A 4/1968 Agostino
3,388,512 A 6/1968 Newman
3,392,497 A 7/1968 Vantine
3,411,252 A 11/1968 Boyle, Jr.
3,460,302 A 8/1969 Cooper
3,469,873 A * 9/1969 Glaros ..... E04D 3/365
52/520
3,490,191 A 1/1970 Ekblom
3,533,205 A 10/1970 Pestel et al.
3,568,380 A 3/1971 Stucky et al.
3,579,935 A 5/1971 Regan et al.
3,590,393 A 7/1971 Hollander
3,594,965 A 7/1971 Saether
3,601,937 A 8/1971 Campbell
3,604,174 A 9/1971 Nelson, Jr.
3,608,258 A 9/1971 Spratt
3,614,803 A 10/1971 Matthews
3,638,380 A 2/1972 Perri
3,707,165 A 12/1972 Stahl
3,713,265 A 1/1973 Wysocki et al.
3,721,056 A 3/1973 Toan
3,722,169 A 3/1973 Boehmig
3,727,753 A 4/1973 Starr
3,742,666 A 7/1973 Antoniou
3,750,366 A 8/1973 Rich, Jr. et al.
3,751,864 A 8/1973 Berger et al.
3,755,974 A 9/1973 Berman
3,762,115 A 10/1973 McCaul, III
3,766,574 A 10/1973 Smid, Jr.
3,821,818 A 7/1974 Alosi
3,823,520 A 7/1974 Ohta et al.
3,845,601 A 11/1974 Kostecky
3,853,452 A 12/1974 Delmonte
3,885,367 A 5/1975 Thunberg
3,906,686 A 9/1975 Dillon
3,921,362 A 11/1975 Ortega
3,926,486 A 12/1975 Sasnett
3,971,605 A 7/1976 Sasnett
3,974,618 A 8/1976 Cortina
3,990,202 A 11/1976 Becker
4,018,020 A 4/1977 Sauer et al.
4,038,796 A 8/1977 Eckel
4,050,215 A 9/1977 Fisher
4,059,936 A 11/1977 Lukens
4,065,905 A 1/1978 Lely et al.
4,078,345 A 3/1978 Piazzalunga
4,107,886 A 8/1978 Ray
4,112,173 A 9/1978 Roudebush
4,114,335 A 9/1978 Carroll
4,142,255 A 3/1979 Togni
4,161,087 A 7/1979 Levesque
4,170,858 A 10/1979 Walker
4,171,545 A 10/1979 Kann
4,176,504 A 12/1979 Huggins
4,178,343 A 12/1979 Rojo, Jr.
4,205,719 A 6/1980 Norell et al.
4,206,162 A 6/1980 Vanderklaauw
4,214,413 A 7/1980 Gonzalez Espinosa de Los Monteros
4,221,441 A 9/1980 Bain
4,226,061 A 10/1980 Day, Jr.
4,227,360 A 10/1980 Balinski
4,248,020 A 2/1981 Zielinski et al.
4,251,974 A 2/1981 Vanderklaauw
4,280,307 A 7/1981 Griffin
4,314,430 A 2/1982 Farrington
4,325,205 A 4/1982 Salim
4,327,529 A 5/1982 Bigelow, Jr.
4,341,052 A 7/1982 Douglass, Jr.
4,361,994 A 12/1982 Carver
4,389,831 A 6/1983 Baumann
4,397,127 A 8/1983 Mieyal
4,435,927 A 3/1984 Umezu
4,441,286 A 4/1984 Skvaril
4,447,987 A 5/1984 Lesosky
4,447,996 A 5/1984 Maurer, Jr.
4,477,934 A 10/1984 Salminen
4,507,901 A 4/1985 Carroll
4,513,545 A 4/1985 Hopkins, Jr.
4,528,793 A 7/1985 Johnson
4,531,336 A 7/1985 Gartner
4,592,175 A 6/1986 Werner
4,646,495 A 3/1987 Chalik
4,648,228 A 3/1987 Kiselewski
4,655,011 A 4/1987 Borges
4,688,750 A 8/1987 Teague et al.
4,712,352 A 12/1987 Low
4,757,663 A 7/1988 Kuhr
4,813,193 A 3/1989 Altizer
4,856,244 A 8/1989 Clapp
4,862,663 A 9/1989 Krieger
4,893,435 A 1/1990 Shalit
4,910,932 A 3/1990 Honigman
4,918,897 A 4/1990 Luedtke
4,919,164 A 4/1990 Barenburg
4,974,366 A 12/1990 Tizzoni
4,991,368 A 2/1991 Amstutz
5,009,043 A 4/1991 Kurrasch
5,010,690 A 4/1991 Geoffrey
5,036,638 A 8/1991 Kurtz, Jr.
5,076,310 A 12/1991 Barenburg
5,079,890 A 1/1992 Kubik et al.
5,127,203 A 7/1992 Paquette
5,127,760 A 7/1992 Brady
5,154,029 A 10/1992 Sturgeon
5,185,971 A 2/1993 Johnson, Jr.
5,205,091 A 4/1993 Brown
5,212,921 A 5/1993 Unruh
5,228,254 A 7/1993 Honeycutt, Jr.
5,233,810 A 8/1993 Jennings
5,254,203 A 10/1993 Corston
5,307,600 A 5/1994 Simon, Jr.
5,359,816 A 11/1994 Iacouides
5,359,820 A 11/1994 McKay
5,361,556 A 11/1994 Menchetti
5,402,612 A 4/1995 diGirolamo et al.
5,412,913 A 5/1995 Daniels et al.
5,426,894 A 6/1995 Headrick
5,452,552 A 9/1995 Ting
5,459,966 A 10/1995 Suarez
5,471,804 A 12/1995 Winter, IV
5,483,773 A 1/1996 Parisien
5,493,838 A 2/1996 Ross
5,509,242 A 4/1996 Rechsteiner et al.
5,519,971 A 5/1996 Ramirez
5,528,877 A 6/1996 Franklin
5,531,539 A 7/1996 Crawford
5,584,142 A 12/1996 Spiess
5,592,796 A 1/1997 Landers

(56) References Cited

U.S. PATENT DOCUMENTS 5,593,115 A 1/1997 Lewis
5,611,173 A 3/1997 Headrick et al.
5,628,158 A 5/1997 Porter
5,640,824 A 6/1997 Johnson
5,660,017 A 8/1997 Houghton
5,678,384 A 10/1997 Maze
5,697,189 A 12/1997 Miller
5,699,643 A 12/1997 Kinard
5,706,607 A 1/1998 Frey
5,724,773 A 3/1998 Hall
5,735,100 A 4/1998 Campbell
5,743,330 A 4/1998 Bilotta et al.
5,746,034 A 5/1998 Luchetti et al.
5,755,982 A 5/1998 Strickland
5,850,686 A 12/1998 Mertes
5,867,964 A 2/1999 Perrin
5,870,867 A 2/1999 Mitchell
5,921,041 A 7/1999 Egri, II
5,970,680 A 10/1999 Powers
5,987,841 A 11/1999 Campo
5,992,109 A 11/1999 Jonker
5,997,792 A 12/1999 Gordon
6,000,194 A 12/1999 Nakamura
6,055,787 A 5/2000 Gerhaher et al.
6,073,401 A 6/2000 Iri et al.
6,073,413 A 6/2000 Tongiatama
6,076,319 A 6/2000 Hendershot
6,086,350 A 7/2000 Del Monte
6,128,877 A 10/2000 Goodman et al.
6,151,851 A 11/2000 Carter
6,154,774 A 11/2000 Furlong
6,170,214 B1 1/2001 Treister et al.
6,199,336 B1 * 3/2001 Poliquin ..... E04B 2/58 52/261
6,240,704 B1 6/2001 Porter
6,243,993 B1 6/2001 Swensson
6,244,002 B1 6/2001 Martin
6,244,008 B1 6/2001 Miller
6,260,329 B1 7/2001 Mills
6,289,646 B1 9/2001 Watanabe
6,301,838 B1 10/2001 Hall
6,308,465 B1 10/2001 Galloway et al.
6,308,491 B1 10/2001 Porter
6,340,508 B1 1/2002 Frommelt
6,371,188 B1 4/2002 Baczuk
6,393,774 B1 5/2002 Fisher
6,421,968 B2 7/2002 Degelsegger
6,427,407 B1 8/2002 Wilson
6,430,883 B1 8/2002 Paz et al.
6,446,396 B1 9/2002 Marangoni et al.
6,481,172 B1 11/2002 Porter
6,484,460 B2 11/2002 VanHaitsma
6,571,523 B2 6/2003 Chambers
6,625,937 B1 9/2003 Parker
6,651,393 B2 11/2003 Don
6,688,056 B2 2/2004 Von Hoyningen Huene et al.
6,729,094 B1 5/2004 Spencer et al.
6,748,709 B1 6/2004 Sherman et al.
6,807,790 B2 10/2004 Strickland et al.
6,837,013 B2 1/2005 Foderberg et al.
6,922,960 B2 8/2005 Sataka
6,935,079 B1 8/2005 Julian et al.
6,964,410 B1 11/2005 Hansen
7,007,343 B2 3/2006 Weiland
7,059,017 B1 6/2006 Rosko
7,143,555 B2 12/2006 Miller
RE39,462 E 1/2007 Brady
7,389,620 B1 6/2008 McManus
7,395,999 B2 7/2008 Walpole
7,444,793 B2 11/2008 Raftery et al.
7,467,469 B2 12/2008 Wall
7,484,329 B2 2/2009 Fiehler
7,484,339 B2 2/2009 Fiehler
7,493,729 B1 2/2009 Semmes
7,546,715 B2 6/2009 Roen
7,574,837 B2 8/2009 Hagen, Jr. et al.
7,640,702 B2 1/2010 Termohlen
7,658,045 B2 2/2010 Elliott et al.
7,676,998 B2 3/2010 Lessard
7,694,462 B2 4/2010 O'Callaghan
7,721,491 B2 5/2010 Appel
7,748,193 B2 7/2010 Knigge et al.
7,908,810 B2 3/2011 Payne, Jr. et al.
7,921,965 B1 4/2011 Surace
7,941,985 B2 5/2011 Simmons
7,966,778 B2 6/2011 Klein
8,051,623 B2 11/2011 Loyd
D652,956 S 1/2012 Tanaka et al.
8,096,084 B2 1/2012 Studebaker et al.
8,109,058 B2 2/2012 Miller
8,127,507 B1 3/2012 Bilge
8,166,716 B2 5/2012 Macdonald et al.
8,234,827 B1 8/2012 Schroeder, Sr.
8,234,833 B2 8/2012 Miller
8,251,175 B1 8/2012 Englert et al.
8,276,328 B2 10/2012 Pépin
8,322,086 B2 12/2012 Weber
8,359,808 B2 1/2013 Stephens, Jr.
8,424,251 B2 4/2013 Tinianov
8,490,349 B2 7/2013 Lutzner
8,505,259 B1 8/2013 Degtyarev
8,539,732 B2 9/2013 Leahy
8,555,581 B2 10/2013 Amend
8,555,589 B2 10/2013 Semmens et al.
8,555,598 B2 10/2013 Wagner et al.
8,621,806 B2 1/2014 Studebaker et al.
8,621,818 B1 1/2014 Glenn et al.
8,631,616 B2 1/2014 Carrion et al.
8,733,046 B2 5/2014 Naidoo
8,769,891 B2 7/2014 Kelly
8,826,613 B1 9/2014 Chrien
8,833,025 B2 9/2014 Krause
8,950,132 B2 2/2015 Collins et al.
8,966,845 B1 3/2015 Ciuperca
8,978,324 B2 3/2015 Collins et al.
8,991,111 B1 3/2015 Harkins
8,997,424 B1 4/2015 Miller
9,027,307 B2 5/2015 Collins et al.
9,382,709 B2 7/2016 Collins et al.
9,637,911 B2 5/2017 Doupe et al.
9,683,361 B2 6/2017 Timberlake et al.
10,041,289 B2 8/2018 Collins et al.
10,273,686 B2 4/2019 Lake
10,323,428 B2 6/2019 Collins et al.
10,370,851 B2 8/2019 Bodwell et al.
10,501,929 B2 12/2019 Henry
10,731,330 B2 8/2020 Petricca
2002/0059763 A1 5/2002 Wong
2002/0092703 A1 7/2002 Gelin et al.
2002/0134036 A1 9/2002 Daudet et al.
2002/0170243 A1 11/2002 Don
2002/0184836 A1 12/2002 Takeuchi et al.
2003/0005653 A1 1/2003 Sataka
2003/0056445 A1 3/2003 Cox
2003/0084629 A1 5/2003 Strickland et al.
2003/0101680 A1 6/2003 Lee
2003/0140571 A1 7/2003 Muha et al.
2003/0167712 A1 9/2003 Robertson
2003/0167719 A1 9/2003 Alderman
2003/0200706 A1 10/2003 Kahan et al.
2003/0221381 A1 12/2003 Ting
2004/0065036 A1 4/2004 Capozzo
2004/0103596 A1 6/2004 Don
2004/0221518 A1 11/2004 Westra
2005/0081484 A1 4/2005 Yland
2005/0108957 A1 5/2005 Quesada
2005/0188626 A1 9/2005 Johnson
2005/0188632 A1 9/2005 Rosen
2005/0198919 A1 9/2005 Hester, Jr.
2005/0204697 A1 9/2005 Rue
2005/0204699 A1 9/2005 Rue
2005/0210764 A1 9/2005 Foucher et al.
2005/0210798 A1 9/2005 Burg et al.
2005/0235571 A1 10/2005 Ewing et al.

(56) References Cited

U.S. PATENT DOCUMENTS

2005/0235581 A1 10/2005 Cohen
2005/0247013 A1 11/2005 Walpole
2005/0262771 A1 12/2005 Gorman
2006/0021289 A1 2/2006 Elmer
2006/0070321 A1 4/2006 Au
2006/0090326 A1 5/2006 Corbett
2006/0096202 A1 5/2006 Delzotto
2006/0117689 A1 6/2006 Onken et al.
2006/0137293 A1 6/2006 Klein
2006/0143856 A1 7/2006 Rosko et al.
2006/0150521 A1 7/2006 Henry
2006/0179764 A1 8/2006 Ito
2006/0248825 A1 11/2006 Garringer
2006/0277841 A1 12/2006 Majusiak
2007/0000198 A1 1/2007 Payne
2007/0074464 A1 4/2007 Eldridge
2007/0107349 A1 5/2007 Erker
2007/0151196 A1 7/2007 Boatwright
2007/0157539 A1 7/2007 Knigge et al.
2007/0163197 A1 7/2007 Payne et al.
2007/0209306 A1 9/2007 Andrews et al.
2007/0234657 A1 10/2007 Speyer et al.
2007/0251168 A1 11/2007 Turner
2007/0283640 A1 12/2007 Shivak et al.
2007/0294954 A1 12/2007 Barrett
2008/0000177 A1 1/2008 Siu
2008/0057290 A1 3/2008 Guevara et al.
2008/0092472 A1 4/2008 Doerr et al.
2008/0098676 A1 5/2008 Hutchens
2008/0099283 A1 5/2008 Reigwein
2008/0104901 A1 5/2008 Olvera
2008/0168741 A1 7/2008 Gilgan
2008/0178542 A1 7/2008 Williams
2008/0178642 A1 7/2008 Sanders
2008/0190053 A1 8/2008 Surowiecki
2008/0202048 A1 8/2008 Miller et al.
2008/0222981 A1 9/2008 Gobbi
2008/0229669 A1 9/2008 Abdollahzadeh et al.
2008/0245007 A1 10/2008 Mcdonald
2008/0279620 A1 11/2008 Berg
2008/0282626 A1 11/2008 Powers, Jr.
2008/0289265 A1 11/2008 Lessard
2008/0295443 A1 12/2008 Simmons
2008/0295450 A1* 12/2008 Yogev ..... E04C 2/26
52/783.1
2009/0031652 A1 2/2009 Ortega Gatalan
2009/0038764 A1 2/2009 Pilz
2009/0064611 A1 3/2009 Hall et al.
2009/0077916 A1 3/2009 Scuderi et al.
2009/0090074 A1 4/2009 Klein
2009/0100760 A1 4/2009 Ewing
2009/0100769 A1 4/2009 Barrett
2009/0100796 A1 4/2009 Denn et al.
2009/0107065 A1 4/2009 LeBlang
2009/0113820 A1 5/2009 Deans
2009/0134287 A1 5/2009 Klosowski
2009/0165399 A1 7/2009 Campos Gines
2009/0188192 A1 7/2009 Studebaker et al.
2009/0188193 A1 7/2009 Studebaker et al.
2009/0205277 A1 8/2009 Gibson
2009/0249714 A1 10/2009 Combs et al.
2009/0277122 A1 11/2009 Howery et al.
2009/0282766 A1 11/2009 Roen
2009/0283359 A1 11/2009 Ravnaas
2009/0293395 A1 12/2009 Porter
2009/0313931 A1 12/2009 Porter
2010/0050556 A1 3/2010 Burns
2010/0058686 A1 3/2010 Henriquez
2010/0064590 A1 3/2010 Jones et al.
2010/0064601 A1 3/2010 Napier
2010/0146874 A1 6/2010 Brown
2010/0146893 A1 6/2010 Dickinson
2010/0186313 A1 7/2010 Stanford et al.
2010/0212255 A1 8/2010 Lesoine
2010/0218443 A1 9/2010 Studebaker
2010/0229472 A1 9/2010 Malpas
2010/0235206 A1 9/2010 Miller et al.
2010/0263308 A1 10/2010 Olvera
2010/0275544 A1 11/2010 Studebaker et al.
2010/0313518 A1 12/2010 Berg
2010/0325971 A1 12/2010 Leahy
2010/0325989 A1 12/2010 Leahy
2011/0023381 A1 2/2011 Weber
2011/0041411 A1 2/2011 Aragon
2011/0056147 A1 3/2011 Beaudet
2011/0113709 A1 5/2011 Pilz
2011/0113715 A1 5/2011 Tonyan et al.
2011/0126484 A1 6/2011 Carrion et al.
2011/0146180 A1 6/2011 Klein et al.
2011/0154766 A1 6/2011 Kralic et al.
2011/0162167 A1 7/2011 Blais
2011/0219720 A1 9/2011 Strickland et al.
2011/0247281 A1 10/2011 Pilz et al.
2011/0268916 A1 11/2011 Pardue, Jr.
2011/0296769 A1* 12/2011 Collins ..... E04B 1/948
52/79.1
2011/0296778 A1 12/2011 Collins et al.
2011/0296789 A1 12/2011 Collins et al.
2011/0300386 A1 12/2011 Pardue, Jr.
2012/0073227 A1 3/2012 Urusoglu
2012/0096800 A1 4/2012 Berg
2012/0137610 A1 6/2012 Knight et al.
2012/0151869 A1 6/2012 Miller
2012/0167505 A1 7/2012 Krause
2012/0186174 A1 7/2012 LeBlang
2012/0210658 A1 8/2012 Logan
2012/0291378 A1 11/2012 Schroeder et al.
2012/0297712 A1 11/2012 Lutzner et al.
2012/0317923 A1 12/2012 Herdt et al.
2013/0025222 A1 1/2013 Mueller
2013/0025966 A1 1/2013 Nam et al.
2013/0036688 A1 2/2013 Gosain
2013/0067832 A1 3/2013 Collins et al.
2013/0111840 A1 5/2013 Bordener
2013/0133277 A1 5/2013 Lewis
2013/0232887 A1 9/2013 Donnini
2014/0013678 A1 1/2014 Deverini
2014/0013684 A1 1/2014 Kelly
2014/0013695 A1 1/2014 Wolynski et al.
2014/0047780 A1 2/2014 Quinn et al.
2014/0059960 A1 3/2014 Cole
2014/0069035 A1 3/2014 Collins
2014/0069040 A1 3/2014 Gibson
2014/0069050 A1 3/2014 Bolin
2014/0083046 A1 3/2014 Yang
2014/0090323 A1 4/2014 Glancy
2014/0130441 A1 5/2014 Sugihara et al.
2014/0317841 A1 10/2014 DeJesus et al.
2014/0338280 A1 11/2014 Tanaka et al.
2015/0007415 A1 1/2015 Kalinowski
2015/0093184 A1 4/2015 Henry
2015/0096251 A1 4/2015 McCandless et al.
2015/0121797 A1 5/2015 Brown et al.
2015/0128518 A1 5/2015 Knight et al.
2015/0136361 A1 5/2015 Gregory
2015/0152634 A1 6/2015 Unger
2015/0211227 A1 7/2015 Collins et al.
2015/0233108 A1 8/2015 Eggleston, II et al.
2015/0252558 A1 9/2015 Chin
2015/0284950 A1 10/2015 Stramandinoli
2015/0297926 A1 10/2015 Dzegan
2015/0308096 A1 10/2015 Merhi et al.
2016/0002912 A1 1/2016 Doupe et al.
2016/0053475 A1 2/2016 Locker et al.
2016/0122996 A1 5/2016 Timberlake et al.
2016/0145933 A1 5/2016 Condon et al.
2016/0258160 A1 9/2016 Radhouane et al.
2016/0290030 A1 10/2016 Collins et al.
2016/0319534 A1 11/2016 Bernardo
2017/0037613 A1 2/2017 Collins et al.
2017/0284095 A1 10/2017 Collins et al.
2017/0299198 A1 10/2017 Collins et al.
2017/0306624 A1 10/2017 Graham et al.
2017/0306625 A1 10/2017 Collins et al.

(56) References Cited

U.S. PATENT DOCUMENTS

| | | | |
|---|---|---|---|
| 2018/0038103 | A1 | 2/2018 | Neumayr |
| 2018/0148926 | A1 | 5/2018 | Lake |
| 2018/0209136 | A1 | 7/2018 | Aylward et al. |
| 2018/0223521 | A1 | 8/2018 | Uno et al. |
| 2018/0328056 | A1 | 11/2018 | Collins et al. |
| 2019/0032327 | A1 | 3/2019 | Musson |
| 2019/0119908 | A1 | 4/2019 | Petricca |
| 2019/0136508 | A1 | 5/2019 | Chaillan |
| 2019/0249409 | A1 | 8/2019 | Boyd et al. |
| 2020/0224407 | A1 | 7/2020 | Ng |

FOREIGN PATENT DOCUMENTS

| | | |
|---|---|---|
| CN | 1313921 | 9/2001 |
| CN | 1234087 | 11/2002 |
| CN | 1742144 | 3/2006 |
| CN | 02137279 | 3/2008 |
| CN | 20137279 | 3/2008 |
| CN | 101426986 | 5/2009 |
| CN | 101821462 | 9/2010 |
| CN | 101831963 | 9/2010 |
| CN | 102105642 | 6/2011 |
| CN | 201952944 | 8/2011 |
| CN | 202117202 | 1/2012 |
| CN | 102459775 | 5/2012 |
| CN | 102587693 | 7/2012 |
| CN | 202299241 | 7/2012 |
| CN | 202391078 | 8/2012 |
| CN | 102733511 | 10/2012 |
| CN | 205024886 | 2/2016 |
| CN | 206070835 | 4/2017 |
| CN | 108487464 | 9/2018 |
| DE | 4205812 | 9/1993 |
| DE | 9419429 | 2/1995 |
| DE | 20002775 | 8/2000 |
| DE | 19918153 | 11/2000 |
| DE | 20315506 | 11/2004 |
| DE | 202008007139 | 10/2009 |
| EP | 0612896 | 8/1994 |
| EP | 1045078 | 10/2000 |
| EP | 0235029 | 2/2002 |
| EP | 1375804 | 1/2004 |
| EP | 1568828 | 8/2005 |
| EP | 2128353 | 12/2009 |
| EP | 2213808 | 8/2010 |
| EP | 2238872 | 10/2010 |
| EP | 1739246 | 1/2011 |
| EP | 2281964 | 2/2011 |
| EP | 3133220 | 2/2017 |
| FR | 1317681 | 5/1963 |
| FR | 2988749 | 10/2013 |
| FR | 2765906 | 1/2019 |
| GB | 898905 | 6/1962 |
| GB | 2481126 | 12/2011 |
| JP | S46-006980 | 12/1971 |
| JP | S49-104111 | 9/1974 |
| JP | 52-015934 | 4/1977 |
| JP | 53-000014 | 1/1978 |
| JP | 53-156364 | 12/1978 |
| JP | 54-084112 | 6/1979 |
| JP | S54-145910 | 11/1979 |
| JP | 56-131749 | 10/1981 |
| JP | 57-158451 | 9/1982 |
| JP | S59-065126 | 5/1984 |
| JP | S60-019606 | 2/1985 |
| JP | 61-144151 | 9/1986 |
| JP | S61-201407 | 12/1986 |
| JP | S6358035 | 3/1988 |
| JP | H01-153013 | 10/1989 |
| JP | H0310985 | 1/1991 |
| JP | H049373 | 3/1992 |
| JP | 6-12178 | 2/1994 |
| JP | 06-212721 | 8/1994 |
| JP | H06220932 | 8/1994 |
| JP | H07-173893 | 7/1995 |
| JP | H0752887 | 12/1995 |
| JP | 8-189078 | 7/1996 |
| JP | H08189078 | 7/1996 |
| JP | H09228510 | 9/1997 |
| JP | 2576409 Y2 | 7/1998 |
| JP | 10234493 | 9/1998 |
| JP | H10245918 | 9/1998 |
| JP | 11-117429 | 4/1999 |
| JP | H11-100926 | 4/1999 |
| JP | 2000-34801 | 2/2000 |
| JP | 2000144997 | 5/2000 |
| JP | 2000-160861 | 6/2000 |
| JP | 3137760 | 2/2001 |
| JP | 3257111 | 2/2002 |
| JP | 2002-309691 | 10/2002 |
| JP | 2002536615 | 10/2002 |
| JP | 2002364104 | 12/2002 |
| JP | 2003-505624 | 2/2003 |
| JP | 2003-278300 | 10/2003 |
| JP | 2003-293493 | 10/2003 |
| JP | 2003278300 | 10/2003 |
| JP | 2004108031 | 4/2004 |
| JP | 2004-344194 | 12/2004 |
| JP | 3664280 | 6/2005 |
| JP | 2006-161406 | 6/2006 |
| JP | 3940621 | 7/2007 |
| JP | 3137760 | 12/2007 |
| JP | 208-063753 | 3/2008 |
| JP | 2008073434 | 4/2008 |
| JP | 2008110104 | 5/2008 |
| JP | 2009-257713 | 11/2009 |
| JP | 2010185264 | 8/2010 |
| JP | 2010245918 | 10/2010 |
| JP | 2011032802 | 2/2011 |
| JP | 3187449 | 11/2013 |
| JP | 2015-117502 | 6/2015 |
| KR | 1019990052255 | 7/1999 |
| KR | 1019990053902 | 7/1999 |
| KR | 100236196 | 12/1999 |
| KR | 102000200413000 | 10/2000 |
| KR | 20060066931 | 6/2006 |
| KR | 20080003326 | 8/2008 |
| KR | 101481790 | 1/2015 |
| KR | 20180092677 | 8/2018 |
| WO | 9107557 | 5/1991 |
| WO | 1991007557 | 5/1991 |
| WO | 1997022770 | 6/1997 |
| WO | 200046457 | 8/2000 |
| WO | 0058583 | 10/2000 |
| WO | 0235029 | 5/2002 |
| WO | 2002035029 | 5/2002 |
| WO | 2006091864 | 8/2006 |
| WO | 2007059003 | 5/2007 |
| WO | 2007/080561 | 7/2007 |
| WO | 2008/113207 | 9/2008 |
| WO | 2010030060 | 3/2010 |
| WO | 2010037938 | 4/2010 |
| WO | 2011/015681 | 2/2011 |
| WO | 2011/116622 | 9/2011 |
| WO | 2015050502 | 4/2015 |
| WO | 2016/032537 | 3/2016 |
| WO | 2016/033429 | 3/2016 |
| WO | 2016032537 | 3/2016 |
| WO | 2016032538 | 3/2016 |
| WO | 2016032539 | 3/2016 |
| WO | 2016032540 | 3/2016 |
| WO | 2016033429 | 3/2016 |
| WO | 2016033525 | 3/2016 |

OTHER PUBLICATIONS

U.S. Appl. No. 12/796,603, filed Jun. 8, 2010, Collins et al.

EPO, European Search Report in PCT/US2015/047383 dated Jun. 22, 2018, 10 Pages.

WIPO, International Search Report and Written opinion for International Application No. PCT/US/2014/053614 dated Dec. 18, 2014, 11 pages.

(56) References Cited

OTHER PUBLICATIONS

WIPO, International Search Report and Written opinion for International Application No. PCT/US/2014/053615 dated Dec. 17, 2014, 11 pages.
WIPO, International Search Report and Written opinion for International Application No. PCT/US/2014/053613 dated Dec. 18, 2014, 13 Pages.
WIPO, International Search Report and Written Opinion for International Application No. PCT/US2011/001039 dated Oct. 5, 2011, 14 Pages.
WIPO, International Search Report and Written opinion for International Application No. PCT/US2015/047383 dated Jan. 12, 2016, 14 Pages.
WIPO, International Search Report and Written opinion for International Application No. PCT/US15/47536 dated Dec. 4, 2015, 17 Pages.
EPO, European Search Report received for POT 14891125.8-1604/3011122 dated Jul. 8, 2016, 4 pages.
WIPO, International Search Report and Written opinion for International Application No. PCT/US/2014/053616 dated Dec. 17, 2014, 9 Pages.
WIPO, International Search Report and Written Opinion for PCT Application No. PCT/US2011/001039 dated Oct. 5, 2011, 9 Pages.
"Beam to column connection", TATA Steel, http://www.tatasteelconstruction.com/en/reference/teaching_resources/architectural_studio_reference/elements/connections/beam to column connections, 2014, 4 Pages.
"Emerging Trends 2012 Executive Summary", Urban Land Institute, Ch. 1, 2011, 1-11 Pages.
"Emerging Trends in real estate", accessed on Sep. 15, 2016 at https://web.archive.orglweb120140813084823/http://pwc.corn.au/industry/real-estate/assets/Real-Estate-2012-Europe-Jan12.pdf, pp. 60, 2012.
"Extended European Search Report for European Application No. EP 15836516.3", dated Jun. 22, 2018, 1 page.
"Extended European Search Report for European Patent Application No. 14900469", dated Mar. 20, 2018, 1-8 pages.
"How to Soundproof a Ceiling—Soundproofing Ceilings", http://www.soundproofingcompany.com/soundproofing-solutions/soundproof-a-ceiling/, Apr. 2, 2014, 1-7 Pages.
"Insulspan Installation Guide", Obtained at: http://www.insuispan.comidownloads:InstallationGuide,pdf on Feb. 2, 2016, 58 pages.
"Structural Insulated Panel", Wikipedia, http://www.en.wikipedia.org//wiki/Structural_insulated_panel, May 30, 2014, 5 Pages.
"Structural Insulated Panels", SIP Solutions, http://www.sipsolutions.com/content/structuralinsulated-panels, Aug. 15, 2014, 3 pages.
"US Apartment & Condominium Construction Forecast 2003-2017", Statista, Inc., Jun. 2012, 8 Pages.
Azari, et al., "Modular Prefabricated Residential Construction—Constraints and Opportunities", PNCCRE Technical Report #TR002, Aug. 2013, 90 Pages.
Borzouie, Jamaledin, et al., "Seismic Assesment and Reahbilitation of Diaphragms", http://www.nosazimadares.ir/behsazi/15WCEE2012/URM/1/Roof.pdf, Dec. 31, 2011, 86 Pages.
EPO, Communication Pursuant to Article 94(3) EPC mailed for European patent application No. 14900469.9, dated Jun. 18, 2019, 5 pages.
EPO, Communication Pursuant to Article 94(3) EPC mailed for EP application No. 15836516.3, dated Apr. 25, 2019, 4 pages.
FRAMECAD, "FC EW 1—12mm Fibre Cement Sheet + 9mm MgO Board Wall Assembly", 2013, 2 pages.
Giles, et al., "Innovations in the Development of Industrially Designed and Manufactured Modular Concepts for Low-Energy, Multi-Story, High Density, Prefabricated Affordable Housing", Innovations in the Development of Industrially Designed and Manufactured Modular Concepts, 2006, 1-15 Pages.
Gonchar, "Paradigm Shift—Multistory Modular", Architectural Record, Oct. 2012, 144-148 Pages.
Kerin, et al., "National Apartment Market Report—2013", Marcus & Millichap, 2013, 1-9 pages.
M.A. Riusillo, "Lift Slab Construction: Its History, Methodology, Economics and Applications", ACI-Abstract, Jun. 1, 1988, 2 pages.
Mcilwain, "Housing in America—The Next Decade", Urban Land Institute, 2010, 1-28 Pages.
Mcilwain, "The Rental Boost From Green Design", Urban Land, http://urbanland.uli.org/sustainability/the-rental-boost-from-green-design/, Jan. 4, 2012, 1-6 Pages.
Shashaty, Andre, "Housing Demand", Sustainable Communities, Apr. 2011, 14-18 Pages.
Sichelman, "Severe Apartment Shortage Looms", Urban Land, http://urbanland.uli.org/capital-markets/nahb-orlando-severe-apartment shortage-looms/, Jan. 13, 2011, 1-2 Pages.
Stiemer, S F, "Bolted Beam-Column Connections", http://faculty.philau.edu/pastorec/Tensile/bolted_beam_column_connections.pdf, Nov. 11, 2007, 1-16 Pages.
WIPO, International Search Report for International Patent Application No. PCT/US2017/021174, dated Jun. 26, 2017, 11 pages.
WIPO, International Search Report for International Patent Application No. PCT/US2017/021168, dated May 19, 2017, 5 pages.
WIPO, Written Opinion for International Patent Application No. PCT/US2017/021174, dated Jun. 26, 2017, 6 pages.
WIPO, International Search Report for International Patent Application No. PCT/US2017/021179, dated May 25, 2017, 7 pages.
WIPO, Written Opinion for International Patent Application No. PCT/US2017/021179, dated May 25, 2017, 7 pages.
WIPO, International Search Report of International Patent Application No. PCT/US2017/021177, dated Jun. 5, 2017, 8 pages.
WIPO, Written Opinion of International Patent Application No. PCT/US2017/021177, dated Jun. 5, 2017, 8 pages.
WIPO, Written Opinion for International Patent Application No. PCT/US2017/021168, dated May 19, 2017, 8 pages.
WIPO, International Search Report and Written Opinion mailed for International application No. PCT/US2014/053614 dated Dec. 18, 2014, 11 pages.
WIPO, International Search Report and Written Opinion mailed for International application No. PCT/US2014/053615 dated Dec. 17, 2014, 11 Pages.
WIPO, International Search Report and Written Opinion mailed for International application No. PCT/US2014/053613 dated Dec. 18, 2014, 13 pages.
WIPO, International Search Report and Written Opinion mailed for International application No. PCT/US2015/047536 dated Dec. 4, 2015, 17 Pages.
WIPO, International Search Report and Written Opinion mailed for International application No. PCT/US2014/053616 dated Dec. 17, 2014, 9 Pages.
EPO, "International Search Report and Written Opinion for PCT Application No. PCT/US2019/38557", dated Sep. 4, 2019, 67 pages.
WIPO, International Search Report and Written Opinion mailed for International application No. PCT/US2019/031370, dated Aug. 7, 2019, 11 pages.
EPO, Extended European Search Report for European Patent Application No. 17763907.7, dated Sep. 13, 2019, 13 pages.
EPO, Communication Pursuant to Article 94(3) EPC for European Patent Application No. 15836516.3, dated Jan. 15, 2020, 5 pages.
EPO, Extended European Search Report for European Patent Application No. 17763910.1, dated Jan. 28, 2020, 13 pages.
EPO, Extended European Search Report for European Patent Application No. 17763914.3, dated Nov. 19, 2019, 10 pages.
EPO, Extended European Search Report for European Patent Application No. 17763913.5, dated Oct. 16, 2019, 8 pages.
EPO, Partial European Search Report for European Patent Application No. 17763910.1, dated Oct. 17, 2019, 16 pages.
EPO, Extended European Search Report for European Patent Application No. 20201601.0, dated Mar. 16, 2021, 10 pages.

* cited by examiner

PREFABRICATED WALL PANEL FOR UTILITY INSTALLATION

CROSS-REFERENCE TO RELATED APPLICATIONS

The present application is a divisional application under 35 U.S.C. § 121 of and claims priority under 35 U.S.C. § 120 to U.S. application Ser. No. 15/507,654, filed on Feb. 28, 2017, now U.S. Pat. No. 10,364,572, which is a U.S. National Stage filing under 35 U.S.C. § 371 of International Application No. PCT/US2014/053613, filed on Aug. 30, 2014. U.S. application Ser. No. 15/507,654 and International Application No. PCT/US2014/053613 are incorporated herein by reference in their entirety.

BACKGROUND

The construction industry is increasingly using modular construction techniques to improve efficiency. In modular construction, entire structures or subassemblies of the structure are prefabricated in an off-site facility. The completed assemblies are then transported to the construction site for installation. Although the structure of the components may be prefabricated, additional components may require installation at the construction site. These components may include electrical wiring, plumbing, data lines, and finishing surfaces. Installation for some of these components may require skilled tradespeople. Requiring tradespeople to travel to multiple construction sites rather than a single prefabrication facility may increase labor costs and reduce time efficiencies.

SUMMARY

Techniques are generally described that include apparatuses, methods, and systems. An example apparatus may be a utility panel that may include an exterior panel, a plurality of studs coupled to the exterior panel, a hat channel coupled to the plurality of studs opposite the exterior panel, wherein the hat channel may be perpendicular to the studs, and an interior panel coupled to the hat channel opposite the plurality of studs.

In some embodiments, the exterior panel may include an embedded spline running horizontally for a width of the exterior panel, wherein the embedded spline may be configured to couple the exterior panel to the plurality of studs.

In some embodiments, the interior panel may include an embedded spline running horizontally for a width of the interior panel, wherein the embedded spline may be configured to couple the interior panel to the hat channel.

In some embodiments, the utility panel may further include a pipe running between and parallel to the plurality of studs, wherein the pipe may be enclosed in a foam carrier. In some embodiments, the foam carrier may extend between two adjacent studs of the plurality of studs and for a length of the utility panel.

In some embodiments, the exterior panel may include a foam plastic core, a magnesium oxide board coupled to an exterior-facing surface of the foam plastic core, a fiber cement board coupled an interior-facing surface of the foam plastic core, a weather resistive barrier coupled to the magnesium oxide board opposite the foam plastic core, and a plurality of cladding panels coupled to the weather resistive barrier opposite the magnesium oxide board. In some embodiments, the plurality of cladding panels may be coupled to the weather resistive barrier by a hat channel running the vertical length of the exterior panel. In some embodiments, the plurality of cladding panels may be configured to act as a rain shield.

In some embodiments, the interior panel may include a fiber cement board coupled to the hat channel and a magnesium oxide board coupled to the fiber cement board opposite the hat channel. In some embodiments, the interior panel may further include an interior finish coupled to the magnesium oxide board opposite the fiber cement board.

In some embodiments, the hat channel may be configured to route an electrical cable through the utility panel.

In some embodiments, the utility panel may span two or more stories of a multi-story building.

In some embodiments, the exterior panel may be configured to form a tab along a first vertical edge of the utility panel and a slot on a second vertical edge of the utility panel, wherein the tab may be configured to fit into the slot of a second utility panel, and the slot may be configured to accept the tab of a third utility panel.

An example method may include coupling an angle to a plurality of studs, wherein the plurality of studs may be included in a wall panel, and coupling the angle to a horizontal beam, wherein the horizontal beam may be included in a multi-story structure.

In some embodiments, the angle and the plurality of studs may comprise steel. In some embodiments, coupling the angle to the plurality of studs may include welding the angle to the plurality of studs.

In some embodiments, coupling the angle to the horizontal beam may include bolting the angle to the horizontal beam.

In some embodiments, the horizontal beam may be a c-channel.

In some embodiments, the wall panel may span two stories or more of the multi-story structure.

In some embodiments, the method may further include sealing the joint between the horizontal beam and the angle, spraying a fire-stop joint spray on the joint between the horizontal beam and the angle, and filling a space between the horizontal beam and the wall panel with mineral wool.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1:
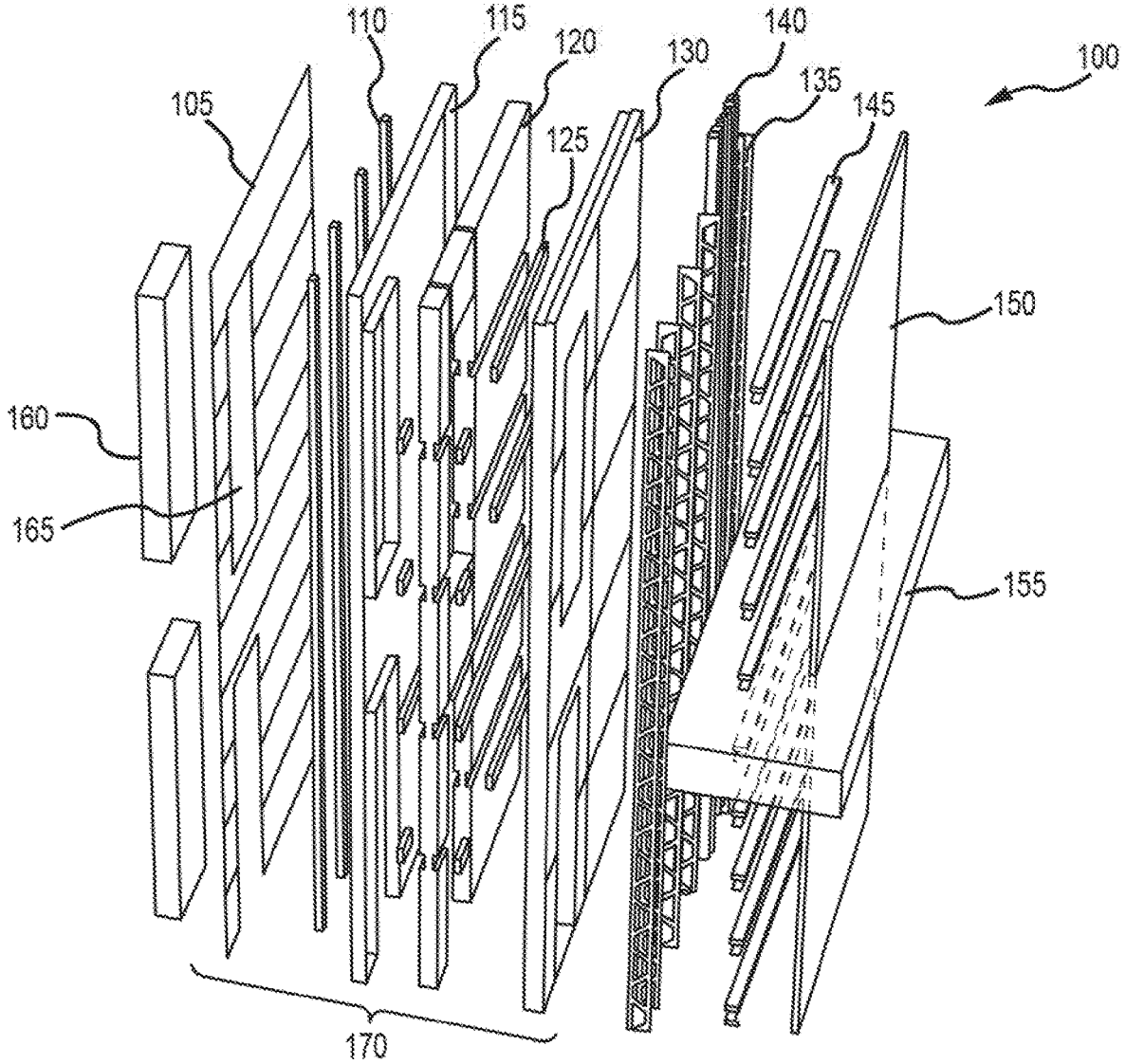
FIG. 1 is a schematic illustration of an exploded view of an example utility panel.

all arranged in accordance with at least some embodiments of the present disclosure.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

This disclosure is drawn, inter alia, to methods, systems, products, devices, and/or apparatuses generally related to a utility panel that may include an exterior panel, a plurality of studs coupled to the exterior panel, a hat channel coupled to the plurality of studs opposite the exterior panel, wherein the hat channel is perpendicular to the studs, and an interior panel coupled to the hat channel opposite the plurality of studs.

In some embodiments, a building may have utilities installed such as plumbing and/or electrical wiring. In some embodiments, when the building is being constructed, prefabricated panels may be installed. The prefabricated panels may provide a portion of an exterior surface of the building and a portion of an interior surface of the building. In some embodiments, the prefabricated panels may be coupled together to form one or more entire walls of the building. In some embodiments, the panels may be load-bearing and may provide support for a floor, a roof, and/or other interior or exterior walls. In some embodiments, the panels are non-load bearing. In some embodiments, the panels are coupled to a load-bearing structure of the building. For example, the load-bearing structure may be an external construction steel frame.

In some embodiments, one or more of the prefabricated panels may have utilities pre-installed. Utilities may include electrical, plumbing, heating and air conditioning, telecommunications and/or other utilities. The prefabricated panels with pre-installed utilities may be referred to as utility panels. The utility panels may have one or more utilities pre-installed. Installing the utilities during fabrication of the utility panel prior to delivery to a building construction site may allow for faster assembly of the building and may reduce the number of skilled tradespeople required for installation of utilities in the building in some embodiments.

In some embodiments, multiple utility panels may be coupled together. The utility panels may be coupled together horizontally and/or vertically. The utilities within the panels may also be coupled together horizontally and/or vertically. This may allow utilities to be provided to multiple units on a story and to multiple units on multiple stories of the building.

In some embodiments, the utility panels may include two structural insulated panels (SIPs) with an interstitial space between them. In some embodiments, the SIPs may include two boards coupled together. In some embodiments, the SIPs may include two boards sandwiching a foam core. In some embodiments, the interstitial space between the SIPS may be maintained by a plurality of studs coupled between the two panels. Utilities may be installed within the interstitial space and between the studs. In some embodiments, the studs may be punched, which may allow utilities to be installed through the openings in the studs. In some embodiments, the utility panel may also include one or more hat channels that may be between the studs and a SIP. The hat channel may also allow for horizontal distribution of utilities across and/or between utility panels.

In some embodiments, pipes for plumbing and/or other utilities may run vertically between the studs. In some embodiments, the pipes are surrounded by foam. In some embodiments, the foam may substantially fill the space between the studs and the SIPS panels. In some embodiments, the foam may at least partially support the pipes. In some embodiments, the foam may hold the pipes in alignment.

In some embodiments, one of the SIPs may be configured to provide at least a portion of an exterior surface of the building. The exterior SIP may include a weather resistive barrier and a rain shield. In some embodiments, the rain shield may also be configured to be a decorative exterior finish. In some embodiments, one of the SIPs may be configured to provide at least a portion of an interior surface of the building. The interior SIP may include a decorative interior finish.

In some embodiments, the studs between the two SIPs panels may be used to couple the utility panel to a structure. In some embodiments, an angle may be coupled to one or more of the studs. The angle may be further coupled to an element of the structure, such as a horizontal beam. In some embodiments, the utility panel may be load-bearing. In some embodiments, the angle may be used to couple the utility panel to a floor. In some embodiments, the load-bearing utility panel may support two or more floors.

In some embodiments, the utility panels may be coupled to other prefabricated panels or walls included in the building. In some embodiments, the utility panel may be coupled to a demising wall. A demising wall may be a wall that at least partially separates two interior spaces in the building. For example, a demising wall may be used to define one or more rooms in the building. In some embodiments, the demising wall is non-load bearing. In some embodiments, the utility panel may not provide support for the demising wall. In some embodiments, the utility panel may be coupled to an exterior wall. The exterior wall may have a similar structure to the utility panel except that utilities are not installed in the exterior wall. The combination of utility panels and exterior walls may form all or a portion of an exterior surface of a building. In some embodiments, additional panel or wall types may be coupled in combination with the utility panel and/or exterior wall.

In some embodiments, the material composition of the utility panel may be predominantly steel. In some embodiments it may be predominately aluminum. In still other embodiments, the utility panel components may be made from a variety of building suitable materials ranging from metals and/or metal alloys, to wood and wood polymer composites (WPC), wood based products (lignin), other organic building materials (bamboo) to organic polymers (plastics), to hybrid materials, or earthen materials such as ceramics. In some embodiments cement or other pourable or moldable building materials may also be used. In other embodiments, any combination of suitable building material may be combined by using one building material for some elements of the utility panel and other building materials for other elements of the utility panel. Selection of any material may be made from a reference of material options (such as those provided for in the International Building Code), or selected based on the knowledge of those of ordinary skill in the art when determining load bearing requirements for the structures to be built. Larger and/or taller structures may have greater physical strength requirements than smaller and/or shorter buildings. Adjustments in building materials to accommodate size of structure, load and environmental stresses can determine optimal economical choices of building materials used for all components in the utility panel described herein. Availability of various building materials in different parts of the world may also affect selection of materials for building the system described herein. Adoption of the International Building Code or similar code may also affect choice of materials.

Any reference herein to "metal" includes any construction grade metals or metal alloys as may be suitable for fabrication and/or construction of the utility panel and components described herein. Any reference to "wood" includes wood, wood laminated products, wood pressed products, wood polymer composites (WPCs), bamboo or bamboo related products, lignin products and any plant derived product, whether chemically treated, refined, processed or simply harvested from a plant. Any reference herein to "concrete" includes any construction grade curable composite that includes cement, water, and a granular aggregate. Granular aggregates may include sand, gravel, polymers, ash and/or other minerals.

Turning now to the drawings, FIG. 1 shows a schematic illustration of an exploded view of an example utility panel 100, arranged in accordance with at least some embodiments described herein. FIG. 1 shows an exterior panel 170 that may be coupled to a plurality of studs 135 that may be coupled to one or more hat channels 145, and an interior panel 150 that may be coupled to the one or more hat channels 145. The exterior panel may include a foam core 120, a fiber cement board 130 coupled to the foam core 120 adjacent to the plurality of studs 135, a magnesium oxide board 115 may be coupled to the foam core 120 on a surface opposite the fiber cement board 130, one or more vertical hat channels 110 may be coupled to the fiber cement board 130, which may be used to couple a plurality of cladding panels 105 to the magnesium oxide board 115. The foam core 120 may further include horizontal splines 125 on one or both surfaces of the foam core 120. The exterior panel 170 may optionally include a cut-out 165 for an electrical box 160 or other utility access. The various components described in FIG. 1 are merely embodiments, and other variations, including eliminating components, combining components, and substituting components are all contemplated.

The exterior panel 170 may form a portion of an exterior surface of a building. In some embodiments, the exterior panel 170 may be a structural insulated panel (SIP). The exterior panel 170 may be configured to resist heat and moisture, such as rain, from permeating the wall. The magnesium oxide board 115 may further include a weather resistive barrier (not shown) coupled to the exterior-facing surface of the fiber cement board 115 such that the weather resistive barrier may be between the magnesium oxide board 115 and the one or more vertical hat channels 110. In some embodiments, the weather resistive barrier may be implemented using one or more layers of spun-bonded polypropylene. In some embodiments, the layers may be ultra violet stabilized. In some embodiments, the weather resistive barrier may be implemented using high-density polyethylene fibers. In some embodiments, the weather resistive barrier may have an adhesive applied to one surface for attachment to the exterior panel 170. Other moisture-resistant materials may be used for the weather resistive barrier. Any other suitable construction material may be used in some embodiments. The cladding panels 105 may act as a rain shield. The cladding panels 105 may be implemented with a metallic material or a polymer material in some embodiments. In some embodiments, the cladding panels 105 may be made of a variety of materials, wherein some cladding panels may be implemented with a different material than other cladding panels.

The horizontal splines 125 may be implemented with wood, fiber cement board, or another material. In some embodiments, the horizontal splines 125 may be implemented with fiber cement board that is about eleven millimeters thick. The horizontal splines 125 may be configured to allow fasteners to be embedded securely to facilitate the coupling of the studs 135 to the external panel 170. Horizontal splines 125 on the exterior side of the external panel 170 may facilitate the coupling of the moisture barrier and vertical hat channels 110. In some embodiments, the splines may be embedded in the foam core 120 horizontally on four foot centers. The horizontal splines 125 may allow the external panel 170 to accept fasteners on both surfaces without causing a thermal break in the panel. This may reduce the transfer of heat and moisture between the interior and exterior of the structure.

In some embodiments, the magnesium oxide board 115 and fiber cement board 130 may completely cover opposite surfaces of the foam core 120. In some embodiments, the magnesium oxide board 115 and/or fiber cement board 130 may be implemented with plywood. In some embodiments, the magnesium oxide board 115 and/or fiber cement board 130 may be implemented with light-weight pre-cast concrete. In some embodiments one or more of the boards 115, 130 may extend beyond one or more edges of the foam core 120. In some embodiments, the foam core 120 may extend beyond one or both boards 115, 130 along one or more edges. In some embodiments, the differing dimensions of the foam core 120 and/or boards 115, 130 may facilitate coupling between adjacent utility panels. In some embodiments, the foam core 120 may be four inches thick. In some embodiments, the foam core may be two pound expanded polystyrene foam. In some embodiments, the foam core may be six inches thick and may be one pound expanded polystyrene foam. In some embodiments, the boards 115, 130 may be about twelve or eleven millimeters thick, respectively. Other thicknesses for the foam core 120 and boards 115, 130 may be used. Different thicknesses and materials may be chosen based on the environmental requirements of the structure. Any other suitable construction material may be used in some embodiments.

In some embodiments, the interior panel 150 may be implemented with a fiber cement board coupled to the one or more hat channels 145 and a magnesium oxide board coupled to a surface of the fiber cement board opposite the hat channels 145. In some embodiments, the fiber cement board may be about eleven millimeters thick and the magnesium oxide board may be about twelve millimeters thick. In some embodiments, the fiber cement board and/or magnesium oxide board may be implemented with plywood. In some embodiments, the fiber cement board and/or magnesium oxide board may be implemented with light-weight pre-cast concrete. In some embodiments, the magnesium oxide board may have an interior finish on its interior-facing surface. The interior finish may be paint, a plurality of decorative panels, or other desired interior finish. In some embodiments, the interior panel 150 may include horizontal splines (not shown) similar to the horizontal splines 125 embedded in the external panel 170. The horizontal splines of the interior panel 150 may facilitate coupling of the interior panel 150 to the one or more hat channels 145. The horizontal splines may allow coupling of the interior panel with fasteners that do not penetrate from the exterior-facing surface of the interior panel 150 to the interior-facing surface of the interior panel 150. In this manner, no thermal break may be formed between the exterior and interior-facing surfaces.

The studs 135, which may be implemented as punched studs as shown, may be formed from a metallic material such as aluminum or steel in some embodiments. In some embodiments, the studs 135 may be light gauge steel punched studs. In some embodiments, the studs 135 are eight inches deep and are spaced at two foot centers. The spacing of the studs may be adjusted based on the load requirements of the structure. In some embodiments, the studs 135 may be implemented using wooden studs. Any other suitable construction material may be used in some embodiments. In some embodiments, openings may be present in the studs 135 which may allow for horizontal distribution of utilities. Accordingly, the studs 135 may define vertical interstitial spaces between the studs 135 for vertical distribution of utilities. Punched studs may define a regular arrangement of such interstitial spaces. In some embodiments, pipes 140 may run vertically between the studs 135. In some embodiments, the pipes 140 may be encased in plastic foam carriers (not shown). The plastic foam carriers may extend the entire length of the studs 135 and the entire width between the studs 135 in some embodiments. The plastic foam carriers may be molded to have spaces through which the pipes 140 pass. The plastic foam carriers may provide structure to support the weight of the pipes 140.

In some embodiments, the one or more hat channels 145 may provide chases for the horizontal distribution of electrical and/or other utilities through the utility panel. In some embodiments, the hat channels 145 may be three inches wide and are mounted horizontally on the studs 135 at two foot centers. For example, the hat channels 145 may be substantially perpendicular to the studs 135. As used herein, substantially perpendicular is defined as an angle formed between two or more elements that is 90 degrees plus or minus 15 degrees. Substantially parallel is defined as having axis in the same direction and not deviating off axis by more than +/−15 degrees in any direction. In some embodiments, the hat channels 145 extend the entire width of the utility panel. In some embodiments, the one or more hat channels 145 may be implemented using steel channels. In some embodiments, the one or more hat channels 145 may be implemented by aluminum channels. In some embodiments, the one or more hat channels 145 may be omitted, and the interior panel 150 may be coupled directly to the studs 135. The interior panel 150 may have one or more chases defined in the surface adjacent to the studs 135 that may be used for the horizontal distribution of utilities.

In some embodiments, the utility panel 100 may contain both plumbing and electrical utilities. In some embodiments, the utility panel 100 may only contain plumbing or electrical utilities. In some embodiments, the utility panel 100 may contain other utilities such as telecommunication equipment, ducts, heating, ventilation, and air conditioning (HVAC) equipment, fire sparkler piping, radiant heat piping, and/or drainage piping.

In some embodiments, the utility panel 100 may span two or more stories of a multi-story building. In some embodiments, the utility panel 100 may provide utilities to two or more residential and/or commercial units. In some embodiments, the utility panel 100 may provide utilities to two different floors of a single residential or commercial unit. An example of a possible delineation 155 between stories is illustrated in FIG. 1. In some embodiments, the utility panel 100 may be eight feet by twenty feet. In some embodiments, the utility panel may be four feet by twenty feet. In some embodiments, the utility panel 100 may be only four feet wide. In some embodiments, the utility panel 100 may be only ten feet high. In some embodiments, the utility panel 100 may extend for an entire width of a multi-unit building. In some embodiments, the utility panel 100 may provide utilities to multiple units on a single story of a building. In some embodiments, the utility panel 100 may extend for an entire height of a multi-story building. The utility panel 100 may be constructed with other dimensions in some embodiments. In some embodiments, the utility panel 100 may be constructed as a wedge, parallelogram, or a non-rectangular shape. The utility panel 100 may be configured to be a shape that may conform to a desired exterior and/or interior surface of a building.

Figure 2:
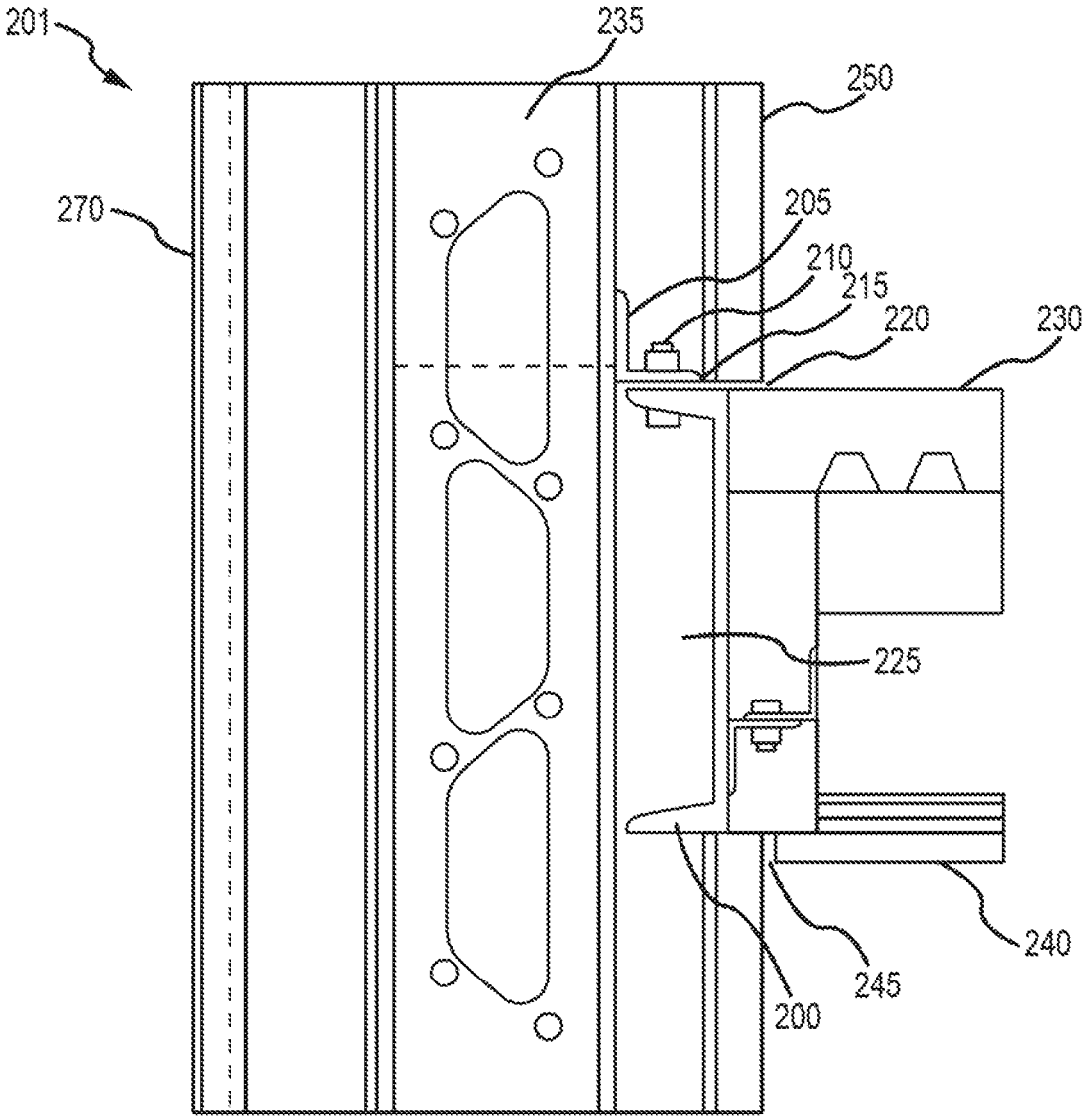
FIG. 2 is a schematic illustration of the example utility panel coupled to an example structure.

FIG. 2 shows a schematic illustration of the example utility panel 201 coupled to an example structure, arranged in accordance with at least some embodiments described herein. FIG. 2 shows a horizontal beam 200 of the example structure from an end-on perspective. That is, the horizontal beam 200 may extend into the page from the perspective of the reader. For clarity, only a limited number of elements of the utility panel 201 are shown including an exterior panel 270, studs 235, and interior panel 250. The utility panel 201 may be coupled to a horizontal beam 200 of the example structure by an angle 205, which may be coupled to the horizontal beam 200 by a fastener 210. Optionally, a sealant 215 may be between the angle 205 and the horizontal beam 200. In some embodiments, a floor panel 230 may also be attached to the horizontal beam 200. The floor panel 230 may form a joint 220 with the utility panel 201. In some embodiments, the interior panel 250 may form a joint 245 similar to joint 220 with a ceiling panel 240 coupled to the horizontal beam 200 located below the floor panel 230. In some embodiments, a gap 225 may exist between the horizontal beam 200 and the utility panel 201. The various components described in FIG. 2 are merely embodiments, and other variations, including eliminating components, combining components, and substituting components are all contemplated.

In some embodiments, the angle 205 is welded to the studs 235. In some embodiments, the angle 205 is bolted to the studs 235. In some embodiments, the studs 235 may be implemented using wooden joists, and the angle 205 may be screwed to the wooden joists.

In some embodiments, the angle 205 is coupled to the upper surface of the horizontal beam 200. In some embodiments, the angle 205 may be coupled to an outer surface of the horizontal beam 200. In some embodiments, the horizontal beam 200 may be implemented as a c-channel as illustrated in FIG. 2. When the horizontal beam 200 is implemented using a c-channel, the angle 205 may be coupled to an inner surface of a channel defined by the c-channel. In some embodiments, the beam 200 is an I-beam. In some embodiments, the fastener 210 is a nut and bolt. In some embodiments the bolts may be ASTM A325 and/or A490 bolts. In some embodiments, the fastener 210 is a rivet. In some embodiments, the fastener 210 may be omitted, and the angle 205 may be welded to the horizontal beam 200.

The angle 205 and horizontal beam 200 may be implemented with a metallic material such as aluminum or steel. In some embodiments, the angle 205 and/or horizontal beam 200 may be implemented using 36K SI A36 steel. In some embodiments, the angle 205 may be implemented with light gauge steel. In some embodiments, the angle 205 and/or horizontal beam 200 may be implemented with wood. In some embodiments, the angle 205 and the horizontal beam 200 may be implemented with different materials. Any other suitable construction material may be used in some embodiments.

In some embodiments, the sealant 215 may be a thermal break material. In some embodiments the sealant 215 may be a moisture resistant material. In some embodiments, the sealant 215 may have both thermal break and moisture resistant properties. In some embodiments, the sealant 215 is silicone. In some embodiments, the joint 220 may be sprayed with a fire-stop joint spray (not shown). In some embodiments, the fire-stop joint spray may form a layer that is at least an eighth of an inch thick. In some embodiments, the fire-stop joint spray is a water-based acrylic dispersion. In some embodiments, other materials may be used to fill the joint 220 such as mineral wool. In some embodiments, the joint 220 may further include a backer rod (not shown). In some embodiments, the backer rod may be a foam rope. The joint 245 may be sprayed and/or filled in a similar manner to joint 220. In some embodiments, the ceiling panel 240 is integrated with the floor panel 230. The floor panel 230 may be a floor for an upper unit, and the ceiling panel 240 may be a ceiling for a lower unit on a separate story of a multi-story building. In some embodiments, the utility panel 201 may form a joint similar to joint 220 and/or 245 with a roof panel and/or parapet (not shown).

In some embodiments, the gap 225 between the horizontal beam 200 and the utility panel 201 may be filled with mineral wool (not shown). In other embodiments, the gap 225 may be filled with foam insulation, fire-stop joint spray, and/or other materials. In some embodiments, multiple materials may be used to fill the gap 225.

In some embodiments, the utility panel 201 may be load bearing. In some embodiments, the horizontal beam 200 may be omitted, and the utility panel 201 may be coupled to the floor panel 230 and/or ceiling panel 240. In some embodiments, the angle 205 may be used to couple the floor panel 230 and/or ceiling panel 240 to the utility panel 201. In some embodiments, an alternative method may be used to couple the floor panel 230 and/or ceiling panel 240 to the utility panel 201.

In some embodiments, the utility panel 201 may have a one hour fire rating. In some embodiments, the one hour fire rating may be achieved in combination with the sealant 215, fire-stop spray, and/or other materials used at joints 220, 245, and gap 225. In some embodiments, the fire rating may be achieved by the utility panel 201 alone, and the additional materials may increase the fire rating of the structure. The materials used and the combination of materials used may be configured to comply with local building codes and/or fire safety codes.

Figure 3:
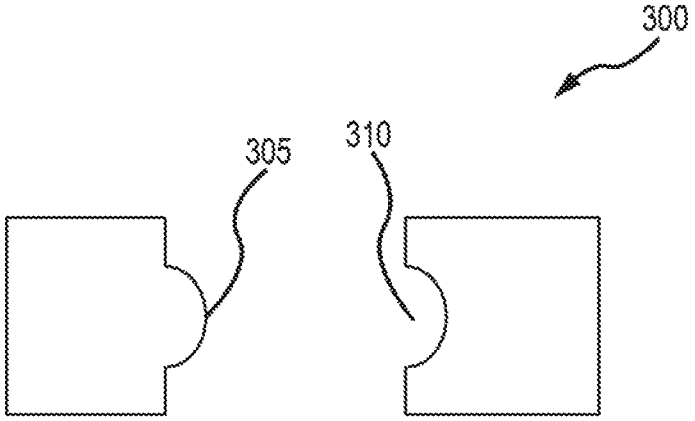
FIG. 3 is a schematic illustration of an example tongue-and-groove system.

FIG. 3 is a schematic illustration of an example tongue-and-groove system 300, arranged in accordance with at least some embodiments described herein. FIG. 3 shows a tab 305 and a socket 310, wherein the tab 305 may be configured to fit within socket 310. The various components described in FIG. 3 are merely embodiments, and other variations, including eliminating components, combining components, and substituting components are all contemplated.

The tongue-and-groove system 300 may allow a plurality of utility panels to be coupled together. Utility panels may be coupled horizontally and/or vertically. The tab 305 and socket 310 may be implemented along one or more edges of a utility panel. In some embodiments, the tab 305 and socket 310 may be formed in the foam core of the external panel. In some embodiments, the tab 305 and socket 310 may be formed in the foam core and the fiber cement boards of the external panels. In some embodiments, a first utility panel may have a tab formed along a first vertical edge of a foam core. The first utility panel may have a socket formed along a second vertical edge of the foam core, parallel to the first vertical edge. The first utility panel may be coupled to a second utility panel along the first vertical edge. The second utility panel may have a socket formed along a vertical edge of a foam core that may be configured to accept the tab formed along the first vertical edge of the first utility panel. In some embodiments, the tab 305 and socket 310 are complementary rounded portions as illustrated in FIG. 3. In some embodiments, the tab 305 and socket 310 are complementary square portions. In some embodiments, other complementary shapes are formed.

In some embodiments, the tab 305 and socket 310 are covered with a weather resistive barrier (not shown). This may decrease thermal and moisture exchange between the interior and exterior of the utility panel. In some embodiments, a weather resistive barrier may be applied over the exterior face of the tongue-and-groove system 300. In some embodiments, a weather resistive barrier may be applied to both the tab 305 and socket 310 and the exterior face of the tongue-and-groove system 300. In some embodiments, the joint formed by the tab 305 and socket 310 may be caulked.

In some embodiments, the tongue-and-groove system 300 may facilitate alignment of the plurality of utility panels. Alignment of the utility panels may reduce complexity of coupling utilities (e.g., electrical wires, pipes) between utility panels. Utilities may be coupled vertically and/or horizontally between adjacent utility panels. In some embodiments, splines may extend from one or more edges of the utility panels to assist with alignment. Other methods of alignment may also be used.

Figure 4:
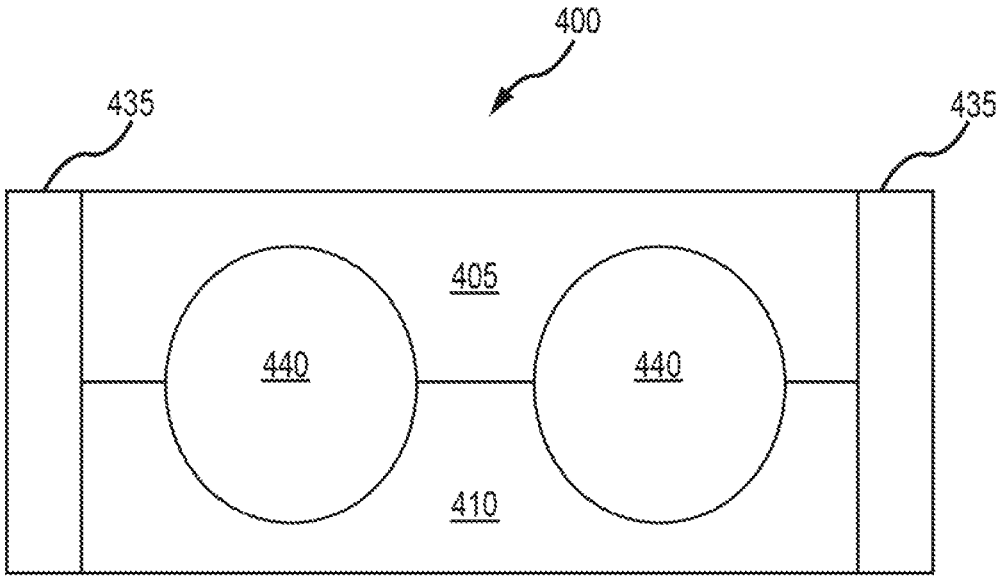
FIG. 4 is a schematic illustration of a top view of example pipes in an example foam carrier between two example punched studs.

FIG. 4 shows a schematic illustration of a top view of example pipes 440 in an example foam carrier 400 between two example studs 435. The various components described in FIG. 4 are merely embodiments, and other variations, including eliminating components, combining components, and substituting components are all contemplated.

In some embodiments, the foam carrier 400 may include a top piece 405 and a bottom piece 410 that may fit together to form a foam block with pipe-shaped cut-outs. In some embodiments, the bottom piece 410 may be installed between the studs 435, and the pipes 440 may be laid in the cut-outs. The top piece 405 may then be installed between the studs 435 to complete the foam carrier 400. In some embodiments, the foam carrier 400 is a single piece of foam formed around the pipes 440 between the studs 435. The pipes 440 may first be put into position and then foam may be introduced between the studs 435 to form the foam carrier 400 from a single piece of foam. In some embodiments, the pipes 440 may be positioned between the studs 435. The pipes 440 may be held in position by wires, clamps, and/or webbing. Foam may then be introduced between the studs 435 to form the foam carrier 400. In some embodiments, a mold is placed around the studs 435 before the foam is introduced. The mold may define, at least in part, an outer shape of the foam carrier 400. In some embodiments, the foam may be implemented with expanded polystyrene foam. In some embodiments, the foam carrier 400 may be implemented with fiberglass. In some embodiments, the foam carrier may be formed from another polymer material. Any other suitable construction material may be used in some embodiments.

Figure 5:
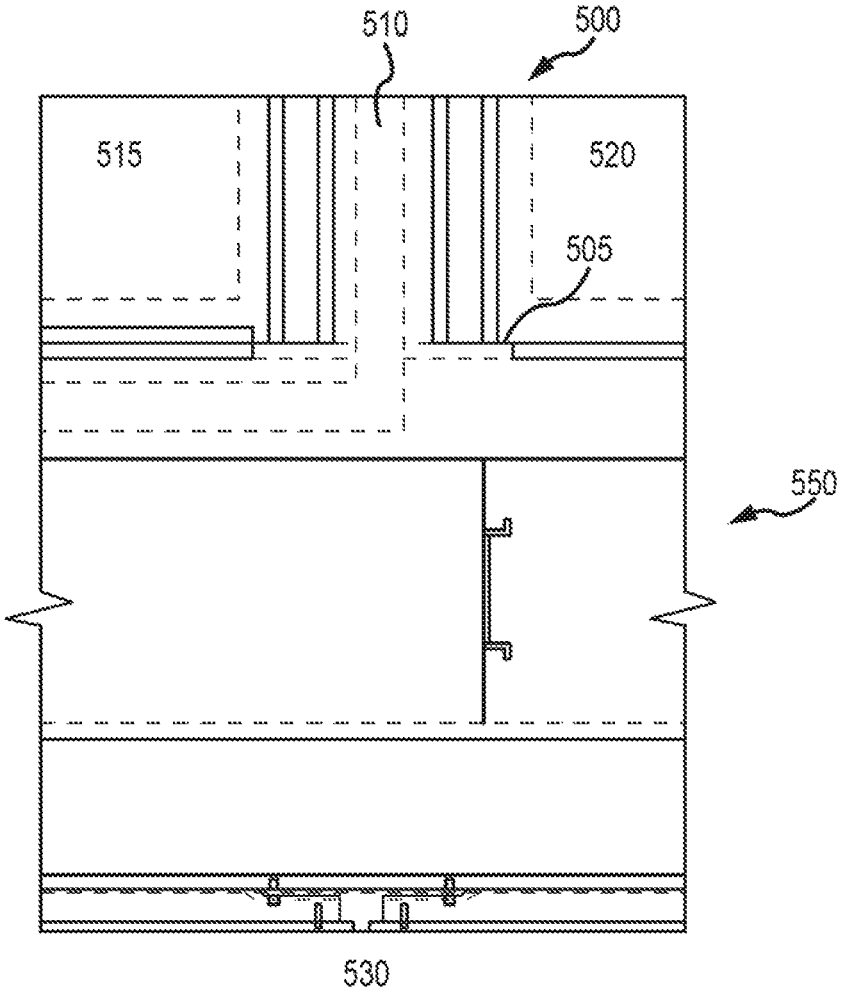
FIG. 5 is a schematic illustration of an example interface between an example interior wall and an example utility panel.

FIG. 5 shows a schematic illustration of an example interface 505 between an example interior wall 500 and an example utility panel 550, arranged in accordance with at least some embodiments described herein. In some embodiments, the interior wall 500 may have an internal interstitial space 510. The interior wall 500 may at least partially separate interior spaces 515, 520. The utility panel 550 may at least partially separate the interior spaces 515, 520 from an exterior space 530. For clarity, not all of the elements of the interior wall 500 and utility panel 550 are shown. The various components described in FIG. 5 are merely embodiments, and other variations, including eliminating components, combining components, and substituting components are all contemplated.

The interior wall 500 may be supported by a floor and/or ceiling of the structure. In some embodiments, the utility panel 550 may not provide any structural support for the interior wall 500. In some embodiments, the interface 505 may be a fire sealant connection. In some embodiments, the fire sealant is a water-based acrylic dispersion. In some embodiments, it may be desirable for the interior wall 500 to have electrical outlets or other utilities. These may be routed from the utility panel 550 to the interior wall 500 through the interstitial space 510 in the interior wall 500.

Figure 6:
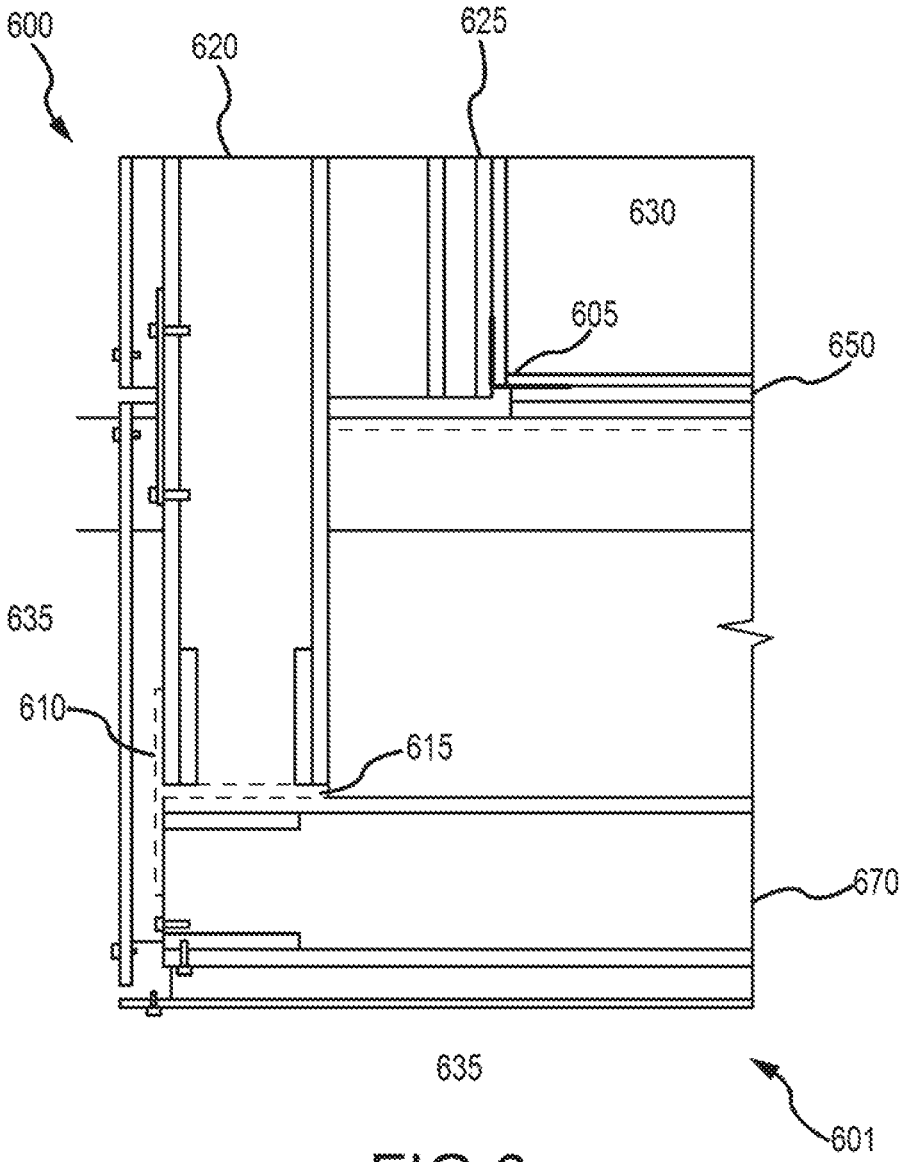
FIG. 6 is a schematic illustration of an example interface between an example exterior wall and an example utility panel.

FIG. 6 shows a schematic illustration of an example interface between an example exterior wall 600 and an example utility panel 601, arranged in accordance with at least some embodiments described herein. For clarity, not all of the elements of the exterior wall 600 and utility panel 601 are shown. FIG. 6 shows the interior panel 625 of the exterior wall 600 and the interior panel 650 of the utility panel 601 coupled by a closing angle 605. The interface of the exterior panel 620 of the exterior wall 600 and the exterior panel 670 of the utility panel 601 are covered by a flexible flashing 610, and the joint formed by the end of the exterior panel 620 abutting the exterior panel 670 is filled with fire caulk 615. The exterior wall 600 and utility panel 601 may at least partially separate an exterior space 635 from an interior space 630. The various components described in FIG. 6 are merely embodiments, and other variations, including eliminating components, combining components, and substituting components are all contemplated.

In some embodiments, the exterior wall 600 may be supported by a floor and/or ceiling of the structure. In some embodiments, the utility panel 601 may not provide any structural support for the exterior wall 600. In some embodiments, the exterior panel 620 may have similar elements as the exterior panel 670. In some embodiments, the exterior panel 620 may have different elements than the exterior panel 670. In some embodiments, a backer rod may be included with the fire caulk 615. In some embodiments, the fire caulk 615 may be a latex-based, intumescent sealant. The flashing 610 may provide for moisture and thermal protection at the interface between the exterior wall 600 and the utility panel 601. In some embodiments, the flashing 610 may be rubber. In some embodiments, the flashing 610 may be non-woven polypropylene fibers. In some embodiments, the flashing 610 may include an acrylic ester polymer adhesive for coupling to the joint formed by the exterior panel 620 and the exterior panel 670. Any other suitable construction material may be used in some embodiments.

In some embodiments, the interior panel 625 may have similar elements as the interior panel 650. In some embodiments, the interior panel 625 may have different elements than the interior panel 650. In some embodiments, the closing angle 605 may extend for the entire length of the exterior wall 600. In some embodiments, the closing angle 605 may be a metallic material such as aluminum or steel. In some embodiments, the closing angle 605 may be wooden. The closing angle 605 may be coupled to the interior panels 525 and 650 by screws. In some embodiments, other fasteners are used.

Figure 7:
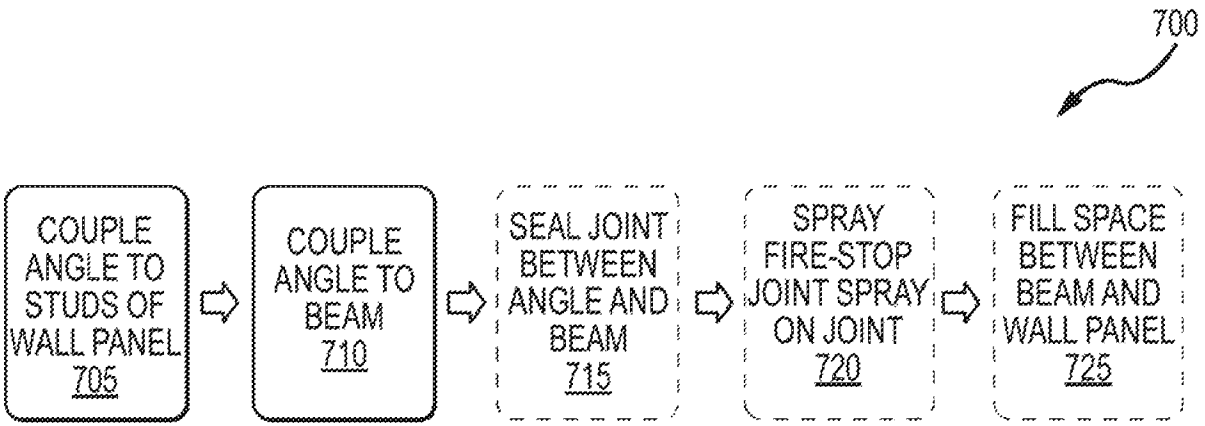
FIG. 7 is a flowchart illustrating an example method.

FIG. 7 shows a flowchart illustrating an example method 700. An example method may include one or more operations, functions or actions as illustrated by one or more of blocks 705, 710, 715, 720, and/or 725. The example method 700 may be used to couple a wall panel, for example, the utility panel, to a structure.

An example process may begin with block 705, which recites "couple angle to studs of wall panel." Block 705 may be followed by block 710, which recites "couple angle to beam." Block 710 may optionally be followed by block 715, which recites, "seal joint between angle and beam." Block 715 may optionally be followed by block 720, which recites, "spray fire-stop joint spray on joint." Block 720 may be optionally followed by block 725, which recites, "fill space between beam and wall panel."

The blocks included in the described example methods are for illustration purposes. In some embodiments, the blocks may be performed in a different order. In some other embodiments, various blocks may be eliminated. In still other embodiments, various blocks may be divided into additional blocks, supplemented with other blocks, or combined together into fewer blocks. Other variations of these specific blocks are contemplated, including changes in the order of the blocks, changes in the content of the blocks being split or combined into other blocks, etc. In some embodiments, the optional blocks may be omitted.

Block 705 recites, "couple angle to studs of wall panel." The wall panel may be a utility panel in some embodiments. The angle may extend for a partial width or a full width of the wall panel. The wall panel may include two or more studs. The number of studs included in the wall panel may be based, at least in part, on the width of the wall panel and structural requirements of the wall panel. In some embodiments, the angle may be implemented with a metallic material such as aluminum or steel. In some embodiments, the studs are punched studs comprising a metallic material such as aluminum or steel. In some embodiments, the studs are wooden. Any other suitable construction material may be used in some embodiments. In some embodiments, the angle may be coupled to the studs by welding. In some embodiments, the angle may be coupled to the studs by screws. In some embodiments, multiple methods of coupling are used. For example, the angle may be coupled to the joists by nuts and bolts then a weld is applied at the bolt.

Block 710 recites, "couple angle to beam." In some embodiments, the beam may be an element of a structure to which the wall panel may be coupled. In some embodiments, the beam may be a horizontal beam. The beam may be implemented as an I-beam in some embodiments. In some embodiments, the beam is a c-channel. In some embodiments, the angle may extend the entire length of the beam. In some embodiments, the length of the beam may be greater than the length of the angle. In some embodiments, the beam may be a metallic material such as steel or aluminum. In some embodiments, the angle may be coupled to the beam by welding. In some embodiments, the angle may be bolted to the beam. In some embodiments, the angle may be riveted to the beam.

Block 715 recites, "seal joint between angle and beam." The joint between the angle and the beam may optionally be sealed in some embodiments. In some embodiments, the joint may be sealed by placing a sealing material between the angle and the beam prior to coupling. In some embodiments, a sealing material may be applied over the joint after the angle and beam have been coupled. The sealing material may be a thermal break material, a fire retardant material, and/or a moisture barrier material. In some embodiments, the sealing material may have multiple properties. In some embodiments, the sealing material may be a sheet that may be cut to the desired dimensions. In some embodiments, the sealing material is a liquid that may be applied to a surface and cure to the surface.

Block 720 recites, "spray fire-stopping joint spray on joint." A portion of the joint between the beam and the wall panel may be adjacent to an interior portion of a structure in some embodiments. Optionally, in some embodiments, the interior facing portion of the joint may be sprayed with a fire-stopping joint spray. The fire stopping-joint spray may provide flame retardant material to the joint. In some embodiments, the spray may be applied after coupling the angle to the beam and sealing the joint between the angle and the beam.

Block 725 recites, "fill space between beam and wall panel." In some embodiments, a space may be present between the wall panel and the beam. In some embodiments, multiple spaces may be present. The spaces between the wall panel and the beam may be above and/or below the joint formed by the angle and the beam. Optionally, the space or spaces between the wall panel and beam may be filled. In some embodiments, the space may be filled with mineral wool. In some embodiments, the space is filled with foam insulation. In some embodiments, the space is filled with two or more different materials.

Embodiments of pre-assembled panels described herein, including the pre-assembled utility panel 100, may provide an interior and exterior wall with utilities system useable in mid-rise and high-rise residential projects, among others. The panels may be configured to comply with one or more of the following building codes: fire, energy, handicap, life-safety, and acoustical (impact and ambient noise transfer). The panels may also be configured to comply with social and/or religious codes as desired. In some embodiments, the pre-assembled utility panels may be considered as a fully-integrated sub-assembly meeting fire, sound impact, energy, and life/safety codes. The utility panels may be fully integrated with electrical, fire protection, energy insulation, and sound isolation capabilities in some embodiments. The utility panels may be designed to achieve a fire rating set by the applicable building code, such as a two-hour fire rating. In some embodiments, the panels may provide a heating system for the building units. Materials, systems, methods, and/or apparatuses may be configured to comply with the International Building Code as it has been adopted in a jurisdiction.

The utility panels described herein may be fabricated off-site in a factory or shop and transported to the project jobsite for attachment to a structural frame, such as a structural exoskeleton, of a building. The off-site fabrication may include provision of utilities in the panels, such as wiring, plumbing, HVAC, and combinations thereof. The panels may be fabricated in various sizes, such as eight feet by twenty-two feet. Smaller infill panels may be prefabricated on a project-by-project basis to complete the building wall system. At the building site, the panel may be attached to floor panels, ceiling panels, end walls, demising walls, other utility walls, building utilities, or any combination thereof. The utility panel may provide support the overall exterior and/or interior wall system, which may include an exterior steel frame installed in the field in some embodiments.

The utility panel may provide an exterior wall and an interior wall. A frame, such as a light gauge frame, may support the utility panel. In some embodiments, the interior wall is drywall, and lightweight decorative panels are attached to the drywall. Opposite the interior wall, the frame may support an exterior wall, such as a structural insulated panel. An in-wall radiant heat member, sound and energy insulation, sound isolators for acoustically separating floors, fire sprinkler piping, electrical wiring and data cabling, or any combination thereof may be positioned between the interior and exterior wall of the utility panel. The utility panel composition may allow for utilities to be distributed both horizontally and vertically within the wall, which may allow for a single utility panel to service multiple units in a multi-story or multi-unit building.

In some embodiments, a pre-assembled floor and ceiling panel may be obtained and used as a floor in a multi-story building that includes the utility panel. In some embodiments, the interior panel of the utility panel forms a joint with the floor and ceiling panel on the interior of the multi-story building. In some embodiments, the floor and ceiling panel may have been assembled at a different location than the building site, however it may in some embodiments be assembled at the building site. In some embodiments, the pre-assembled panel may include a closure piece that may facilitate the coupling of a window wall to the floor and ceiling panel along an edge opposite and/or adjacent to the utility panel. In some embodiments, the closure piece is coupled to the floor and ceiling panel at a later point in time. The floor and ceiling panels may include a plurality of joists and a corrugated form deck disposed above and attached to the plurality of joists. In some embodiments, the closure piece is coupled to the deck. In some embodiments, the closure piece is coupled to one or more of the joists. In some embodiments, the closure piece is coupled to both the deck and the joists. In some embodiments, the closure piece is on an opposite edge of the floor and ceiling panel as an edge of the floor and ceiling panel that forms a joint with the utility panel.

The floor and ceiling panel may be attached to the frame of a building. For example, the floor and ceiling panel may be attached to an exterior steel structure, which may provide the structural support for a building. Generally, any mechanism may be used to attach the floor and ceiling panel, or multiple floor and ceiling panels, to the frame of the building, such as an external steel structure. Any type of fastening may generally be used. In some embodiments, the floor and ceiling panel and the utility panel may be coupled to a same horizontal beam included in the frame of the building.

Concrete may be poured onto the floor and ceiling panel. Pouring the concrete may form a diaphragm of the building, which may span an entire story of the building in some embodiments. In some embodiments, the diaphragm may transmit lateral loads to the lateral load system of the building. In this manner, the concrete may be poured at the completed height of the story of the building, after the floor and ceiling panels have been positioned at the desired story, thereby forming the floor of units in that story. In some embodiments, the utility panels are installed after the concrete has cured on the floor and ceiling panels.

Embodiments of pre-assembled floor and ceiling panels may provide a floor and ceiling system useable in mid-rise and high-rise residential projects, among others. The panels with or without the closure pieces and tracks installed may be configured to comply with one or more of the following building codes: fire, energy, handicap, life-safety, and acoustical (impact and ambient noise transfer). In some embodiments, the pre-assembled floor and ceiling panels with or without the closure pieces and tracks may be considered as a fully-integrated sub-assembly meeting fire, sound impact, energy, and life/safety codes. The floor and ceiling panels may be fully integrated with electrical, fire protection, energy insulation, and sound isolation capabilities in some embodiments. The floor and ceiling panels may be designed to achieve a fire rating set by the applicable building code, such as a two-hour fire rating.

The floor and ceiling panels described herein may be fabricated off-site in a factory or shop and transported to the project jobsite for attachment to a structural frame, such as a structural exoskeleton, of a building. The panels and closure pieces may be fabricated in various sizes, such as eight feet by twenty-two feet. Smaller infill panels may be prefabricated on a project-by-project basis to complete the building floor system. At the building site, the panel may be attached to end walls, demising walls, utility panels, building utilities, or any combination thereof. The floor and ceiling panel may provide support the overall floor system, which may include a concrete topping slab poured in the field to create a structural diaphragm for the building. In some embodiments, the floor and ceiling panel transfers loads to the utility panel. In some embodiments, the floor and ceiling panel transfers loads directly to a steel structure of the building, and the utility panel does not translate loads from the floor and ceiling panel to the structure. In some embodiments, the utility panel is non-load bearing.

Example I

In a first non-limiting example, a prefabricated utility panel may include an exterior SIPs panel. The utility panel may be eight feet wide and twenty feet high. The SIPs panel may be made from a two-pound expanded polystyrene foam panel that is four inches thick. A magnesium oxide board may be coupled to the exterior facing side of the foam panel, and a fiber cement board may be coupled to the interior facing side of the foam panel. The foam panel may have horizontal fiber cement board splines embedded in the foam on both sides under the boards sandwiching the foam. The splines may be four inches wide and embedded every four feet the length of the foam panel.

A multi-layer spun-bonded polypropylene weather resistive barrier may cover the exterior of the magnesium oxide board. Four light gauge steel hat channels may be coupled to the magnesium oxide board over the weather resistive barrier. The vertical hat channels may be evenly spaced across the width of the panel. Fasteners coupling the hat channel to the panel may be at least partially embedded in the splines. Painted light gauge steel panels may be coupled to the vertical hat channels. The panels may act as both a decorative finish and a rain shield.

Eight inch deep light gauge steel punched studs may be coupled to the fiber cement board at two foot centers. The studs may be twenty feet long, spanning the length of the utility panel. Fasteners coupling the fiber cement board to the punched studs may be at least partially embedded in the splines.

Electrical utilities may be installed between two adjacent studs. A polystyrene foam pipe carrier may extend between two additional adjacent studs and extend the entire length of the studs. The pipe carrier may have pipes embedded in the foam.

A series of light gauge steel horizontal hat channels may be coupled to the studs at four foot intervals along the length of the studs. The horizontal hat channels may span the entire width of the utility panel. The horizontal hat channels may define three inch channels. Electrical wiring may be installed in the horizontal hat channels.

An interior panel of the utility panel may be a fiber cement board coupled to a magnesium oxide board. The fiber cement board may have horizontal fiber cement board splines coupled to a surface opposite the magnesium oxide board. The splines may be similar to the splines in the exterior SIP and may be spaced at similar intervals. The interior panel may be coupled to the horizontal hat channels. The fasteners coupling the interior panel to the hat channels may be at least partially embedded in the splines. The magnesium oxide board may be the interior wall of a room in a building. The magnesium oxide board may be coupled to a plurality of colorful plastic panels. The panels may act as a decorative finish for the room.

Example II

In a second non-limiting example, a prefabricated utility panel may include an exterior SIPs panel. The utility panel may be eight feet wide and twelve feet high. The SIPs panel may be made from a one-pound expanded polystyrene foam panel that is six inches thick. A plywood board may be coupled to the exterior facing side of the foam panel, and a second plywood board may be coupled to the interior facing side of the foam panel. The foam panel may have horizontal wooden splines embedded in the foam on both sides under the boards sandwiching the foam. The splines may be four inches wide and embedded every four feet the length of the foam panel.

A high-density polyethylene fiber weather resistive barrier may cover the exterior of the SIP. Wooden siding may be coupled to the exterior of the SIP over the weather resistive barrier. Fasteners coupling the siding may be at least partially embedded in the splines. The wooden siding may be painted with a latex-based paint.

Wooden studs may be coupled to the inner plywood of the SIP at two foot centers. The studs may be ten feet long, spanning the length of the utility panel. Fasteners coupling the plywood to the studs may be at least partially embedded in the splines.

Electrical utilities may be installed between two adjacent studs. A foam pipe carrier may extend between two additional adjacent studs and extend the entire length of the studs. The pipe carrier may have pipes embedded in the foam.

A series of wooden strips that define horizontal chases may be coupled to the studs at four foot intervals along the length of the studs. The horizontal chases may span the entire width of the utility panel. The horizontal chases may be three inches wide. Electrical wiring may be installed in the chases.

An interior panel of the utility panel may be a plywood board coupled to a magnesium oxide board. The interior plywood board may be coupled to the wooden strips. The magnesium oxide board may be the interior wall of a room in a building. The magnesium oxide board may be painted as a decorative finish for the room.

Example III

In a third non-limiting example, a prefabricated utility panel may include an exterior SIPs panel. The utility panel may be eight feet wide and twenty feet high. The SIPs panel may be made from a pre-cast light weight concrete panel that is two inches thick. A magnesium oxide board may be coupled to the exterior facing side of the foam panel, and a fiber cement board may be coupled to the interior facing side of the foam panel. The concrete panel may have horizontal plywood splines embedded in the concrete on both sides under the boards sandwiching the concrete. The splines may allow the boards to be coupled to the concrete. The splines may be four inches wide and embedded every four feet the length of the concrete panel.

A multi-layer spun-bonded polypropylene weather resistive barrier may cover the exterior of the magnesium oxide board. Steel siding may be coupled to the magnesium oxide board over the weather resistive barrier. Fasteners coupling the steel siding to the panel may be at least partially embedded in the splines. Painted light gauge steel panels may be coupled to the vertical hat channels. The panels may act as both a decorative finish and a rain shield.

Aluminum punched studs may be coupled to the fiber cement board at two foot centers. The studs may be twenty feet long, spanning the length of the utility panel. Fasteners coupling the fiber cement board to the punched studs may be at least partially embedded in the splines.

Electrical utilities may be installed between two adjacent studs. A polystyrene foam pipe carrier may extend between two additional adjacent studs and extend the entire length of the studs. The pipe carrier may have pipes embedded in the foam.

A series of plastic hat channels may be coupled to the studs at four foot intervals along the length of the studs. The horizontal hat channels may span the entire width of the utility panel. The horizontal hat channels may define three inch channels. Electrical wiring may be installed in the horizontal hat channels.

An interior panel of the utility panel may be a fiber cement board coupled to a magnesium oxide board. The fiber cement board may have horizontal fiber cement board splines coupled to a surface opposite the magnesium oxide board. The splines may be similar to the splines in the exterior SIP and may be spaced at similar intervals. The interior panel may be coupled to the horizontal hat channels. The fasteners coupling the interior panel to the hat channels may be at least partially embedded in the splines. The magnesium oxide board may be the interior wall of a room in a building. The magnesium oxide board may be coupled to a plurality of wooden panels. The panels may act as a decorative finish for the room.

The examples provided are for explanatory purposes only and should not be considered to limit the scope of the disclosure. Each example embodiment may be practical for a particular environment such as urban mixed-use developments, low-rise residential units, and/or remote communities. Materials and dimensions for individual elements may be configured to comply with one or more of the following building codes: fire, energy, handicap, life-safety, and acoustical (impact and ambient noise transfer) without departing from the scope of the principles of the disclosure. The elements and/or system may also be configured to comply with social and/or religious codes as desired. For example, materials, systems, methods, and/or apparatuses may be configured to comply with the International Building Code as it has been adopted in a jurisdiction.

The present disclosure is not to be limited in terms of the particular embodiments described in this application, which are intended as illustrations of various aspects. Many modifications and embodiments can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and embodiments are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 items refers to groups having 1, 2, or 3 items. Similarly, a group having 1-5 items refers to groups having 1, 2, 3, 4, or 5 items, and so forth.

The herein described subject matter sometimes illustrates different components contained within, or connected with, different other components. It is to be understood that such depicted architectures are merely embodiments, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific embodiments of operably couplable include but are not limited to physically mateable and/or physically interacting components and/or wirelessly interactable and/or wirelessly interacting components and/or logically interacting and/or logically interactable components.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method to couple a wall panel to a structure of a multi-story building, the method comprising:

coupling an angle to one or more studs of a plurality of studs, wherein the plurality of studs are included in the wall panel, and wherein the wall panel has a size that spans multiple stories of the multi-story building;

coupling the angle to a horizontal beam, wherein the horizontal beam is included in the structure of the multi-story building, wherein the wall panel forms a portion of an exterior surface and a portion of an interior surface of the multiple stories of the multi-story building, wherein the wall panel provides utilities to the multiple stories of the multi-story building, and wherein the utilities include:

a first utility that runs vertically within at least one space defined between at least two studs, of the plurality of studs, that are positioned vertically along a first plane; and a second utility that runs horizontally along at least one hat channel, of the wall panel, that is positioned horizontally along a second plane that is parallel to the first plane and that avoids the first plane; and applying a material to a joint between the horizontal beam and the angle, wherein the material has at least one of a thermal break property or a moisture resistant property.

2. The method of claim 1, wherein the angle and the plurality of studs comprise steel.

3. The method of claim 1, wherein coupling the angle to the one or more studs of the plurality of studs comprises welding the angle to the one or more studs of the plurality of studs.

4. The method of claim 1, wherein coupling the angle to the horizontal beam comprises bolting the angle to the horizontal beam.

5. The method of claim 1, wherein the horizontal beam includes a c-channel.

6. The method of claim 1, wherein:

the first utility runs in a pipe located within the at least one space defined between the at least two studs of the plurality of studs, and the at least one hat channel of the wall panel is coupled to at least some of the plurality of studs.

7. The method of claim 6, wherein the first utility includes a plumbing utility, and wherein the second utility includes an electrical utility.

8. The method of claim 1, wherein the utilities include one or more of: plumbing utilities, electrical utilities, telecommunication equipment, ducts, HVAC (heating, ventilation, and air conditioning) equipment, fire sprinkler piping, radiant heat piping, or drainage piping.

9. The method of claim 1, wherein the material includes at least one of silicone, a water-based acrylic dispersion, mineral wool, foam, a sheet, or a liquid that is cured, and wherein applying the material to the joint between the horizontal beam and the angle includes at least one of:

sealing the joint between the horizontal beam and the angle;

spraying a fire-stop joint spray on the joint between the horizontal beam and the angle; and filling a space, near the joint and between the horizontal beam and the wall panel, with mineral wool.

10. The wall panel to be coupled to the structure in accordance with the method of claim 1.

11. A method to couple a wall panel to a structure of a multi-story building, the method comprising:

providing a pre-assembled wall panel having a size that spans multiple stories of the multi-story building, wherein:

the pre-assembled wall panel includes a plurality of studs, the pre-assembled wall panel provides utilities to the multiple stories of the multi-story building, and the utilities include a first utility that runs vertically within at least one space defined between at least two studs, of the plurality of studs, that are positioned vertically along a first plane, and a second utility that runs horizontally along at least one hat channel, of the pre-assembled wall panel, that is positioned horizontally along a second plane that is spaced from the first plane;

coupling an angle to one or more studs of the plurality of studs; and coupling the angle to a horizontal beam of the structure of the multi-story building, wherein the pre-assembled wall panel forms a portion of an exterior surface and a portion of an interior surface of the multiple stories of the multi-story building.

12. The method of claim 11, wherein:

the first utility runs in a pipe located within the at least one space defined between the at least two studs of the plurality of studs, and the at least one hat channel of the pre-assembled wall panel is coupled to at least some of the plurality of studs.

13. The method of claim 11, wherein the first utility includes a plumbing utility, and wherein the second utility includes an electrical utility.

14. The method of claim 11, wherein coupling the angle to one or more studs of the plurality of studs includes welding, screwing, or bolting the angle to the one or more studs.

15. The pre-assembled wall panel to be coupled to the structure in accordance with the method of claim 11.

16. A pre-assembled wall panel, comprising:

a plurality of studs, wherein adjacent studs of the plurality of studs define interstitial spaces between the adjacent studs;

at least one hat channel mounted horizontally on outward facing surfaces of at least some of the plurality of studs such that the at least one hat channel is positioned outside of the interstitial spaces;

a first utility that runs vertically within at least one interstitial space defined between the adjacent studs; and a second utility that runs horizontally along the at least one hat channel and outside of the interstitial spaces defined by the adjacent studs, wherein the pre-assembled wall panel has a size that spans multiple stories of a multi-story building, and wherein the pre-assembled wall panel provides at least the first utility to the multiple stories of the multi-story building.

17. The pre-assembled wall panel of claim 16, wherein the first utility runs in a pipe located within the at least one interstitial space defined between the adjacent studs.

18. The pre-assembled wall panel of claim 16, wherein the first utility includes a plumbing utility, and wherein the second utility includes an electrical utility.

* * * * *